US009291362B2

(12) United States Patent
Bohlender et al.

(10) Patent No.: US 9,291,362 B2
(45) Date of Patent: Mar. 22, 2016

(54) ELECTRICAL HEATING DEVICE AND SUITABLE FRAME

(71) Applicant: Eberspächer catem GmbH & Co. KG, Herxheim (DE)

(72) Inventors: Franz Bohlender, Kandel (DE); Michael Niederer, Kapellen-Drusweiler (DE); Christian Morgen, Rülzheim (DE)

(73) Assignee: Eberspacher catem GmbH & Co. KG, Herxheim (DE)

( * ) Notice: Subject to any disclaimer, the term of this patent is extended or adjusted under 35 U.S.C. 154(b) by 456 days.

(21) Appl. No.: 13/723,346

(22) Filed: Dec. 21, 2012

(65) Prior Publication Data

US 2013/0163969 A1 Jun. 27, 2013

(30) Foreign Application Priority Data

Dec. 22, 2011 (EP) ..... 11010085

(51) Int. Cl.
*H05B 3/26* (2006.01)
*F24H 1/00* (2006.01)

(52) U.S. Cl.
CPC ..... *F24H 1/0018* (2013.01); *H05B 2203/02* (2013.01); *H05B 2203/023* (2013.01)

(58) Field of Classification Search
CPC ..... H05B 3/06; H05B 3/26; H05B 3/30; H05B 3/50; H05B 2203/02; F24H 3/0405; F24H 3/0435
USPC ..... 219/202, 504, 520, 537, 540, 541, 544, 219/548
See application file for complete search history.

(56) References Cited

U.S. PATENT DOCUMENTS

2009/0026194 A1* 1/2009 Bohlender et al. ..... 219/532

FOREIGN PATENT DOCUMENTS

| | | | |
|---|---|---|---|
| DE | 4404345 | A1 | 8/1994 |
| EP | 1626231 | A1 | 2/2006 |
| EP | 1780061 | A1 | 5/2007 |
| WO | 2012016686 | A1 | 2/2012 |

OTHER PUBLICATIONS

EP 1780061 Machine translation performed on Feb. 20, 2015, document published in 2007.*
European Search Report Dated Aug. 27, 2012 for European Patent Application Serial No. EP 11 01 0085.

* cited by examiner

*Primary Examiner* — Brian Jennison
(74) *Attorney, Agent, or Firm* — Boyle Fredrickson, S.C.

(57) ABSTRACT

An electrical heating device includes a frame and a layer structure arranged in the frame and comprising layers of corrugated ribs and PTC-based heat generating elements. The electrical heating device includes at least two corrugated-rib elements. The frame has two frame elements forming openings and at least one frame intermediate element arranged between them. A frame, formed solely by the frame elements, forms an accommodation space extending in the passage direction of the medium to be heated, which is appropriately formed for the accommodation of a layer structure with a level of corrugated ribs and heat generating elements. A frame, formed by the frame elements and the frame intermediate element, forms an accommodation space extending in the passage direction of the medium to be heated, which is formed for the accommodation of a layer structure with several levels of corrugated ribs and heat generating elements.

17 Claims, 17 Drawing Sheets

ELECTRICAL HEATING DEVICE AND SUITABLE FRAME

BACKGROUND OF THE INVENTION

1. Field of the Invention

The present invention relates to an electrical heating device with a frame which, on opposite sides, forms openings for the passage of a medium to be heated. The electrical heating device also has a layer structure arranged in the frame. In a direction transverse to the passage direction of the medium to be heated the said layer structure has several layers which are formed by corrugated-rib elements and at least one heat generating element. The heat generating element here comprises at least one PTC element arranged between parallel contact plates.

2. Description of the Related Art

An electrical heating device of this nature is for example known from DE 199 11 547, U.S. Pat. No. 5,854,471, EP 0 350 528 or DE 197 06 199.

The state of the art as presented in EP 2 161 514 A1 is also regarded as class-forming. This state of the art is also the basis of the problem definition which is also based on the present invention. This involves providing an electrical heating device of the generic type which enables an increased heating power with a compact construction.

Here, with generic electrical heating devices, due to the self-regulating properties of the PTC element there is the problem that with increasing temperature and also heating power the resistance of the PTC elements increases sharply so that the power dissipation of the PTC elements is reduced. Since, on the other hand, the electrical heating devices are particularly used in motor vehicles, they should have a compact design so that the suggestion that two electrical heating devices formed in the conventional way are arranged one behind the other in a HVAC in the flow direction or passage direction of the medium to be heated must be rejected, because it is contrary to the requirement of a compact design.

EP 2 161 514 A1 suggests that several corrugated-rib elements are arranged one behind the other in the direction of flow of the air to be heated and within a uniform frame. According to the prior-art suggestion at least two heating blocks are arranged one behind the other in the passage direction of the air to be heated. Here, the heating blocks are provided at least offset, i.e. the heat generating elements of the individual heating blocks are not directly situated one behind the other in the passage direction of the medium to be heated. Rather, they have a lateral spacing to one another in this passage direction in this otherwise parallel alignment of the layers of the various heating blocks relative to one another. The heat generating elements of one heating block are here located centrally behind the corrugated-rib elements of the other heating block. Here, the suggestion according to EP 2 161 514 A1 is obviously being led by the consideration that the exiting air heated in the flow direction of the front heating block has experienced the strongest heating directly adjacent to the heat generating element, whereas the central region in the extrapolated direction of the individual corrugated-rib elements experiences only a relatively slight heating of the air due to the largest distance of this central region from the heat generating element, so that this relatively cool air should meet according to the notion the region of strongest heating effect of the following heating block.

However, with the known suggestion, due to those heat generating elements, which are located after the through-flow corrugated-rib elements and arranged in their flow path, the passage openings for the air are displaced by the electrical heating device, whereupon a relatively high flow resistance results. Thus, however the heating power and the effectiveness of the electrical heating device is also reduced, because it is not solely defined by the temperature change caused by the electrical heating device, but rather by the amount of air heated by this temperature change. Furthermore, only part of the area provided for the heat exchange with the air is used, because the corrugated-rib elements located in the flow direction after the heat generating elements are shaded from these heat generating elements and namely by approximately one third of their area for a corrugated-rib height of 10 mm and a thickness of the heat generating element of approximately 3 mm.

SUMMARY OF THE INVENTION

The object of the present invention is to provide an electrical heating device with an increased heating power. Here, the intention of the present invention is to provide especially a scalable electrical heating device, i.e. a device of a nature such that it can be adapted to different heating powers without a large outlay. The intention of the present invention is also to provide a frame with which an appropriate heating device can be realized in an economical manner.

The object is resolved in the present invention by an electrical heating device having a frame, which forms on oppositely situated sides openings for the passage of a medium to be heated, and a layer structure, which is arranged in the frame and which comprises the layers of corrugated ribs and heat generating elements. The heat generating element has at least one PTC element arranged between parallel contact plates. The individual layers extend from one opening of the housing to the other in the passage direction of the medium. In the passage direction of the medium to be heated, at least two corrugated-rib elements are arranged one behind the other, and their corrugated ribs are arranged lateral to the passage direction of the medium to be heated. In the inventive electrical heating device, plural corrugated-rib elements are arranged as separate elements in a single layer, i.e. one after the other in the passage direction of the medium, which is a direction perpendicular to the appositively situated side openings of the frame. The corrugated-rib elements are arranged offset laterally to the passage direction of the medium, i.e. perpendicular to said passage direction, but within the same layer. In other words, the offset is an offset in the longitudinal direction of the corrugated-rib elements, which is the extension direction of those elements defining the layer. In a view of the heating device according to the invention in the passage direction of the medium to be heated at the height of the corrugated-rib elements arranged one behind the other, the corrugated ribs of the elements provided in at least two, preferably three or more, levels one behind the other in the flow direction can be recognised. The individual corrugated ribs are only shaded correspondingly slightly. Nevertheless, from the transition from the corrugated rib provided on one input level to the one situated behind, at best a corrugated rib assigned to an output level, destratification of the flow is achieved in that the flow path is modified by the corrugated ribs provided offset. A turbulent flow is produced on the transition between the two corrugated-rib elements provided offset, which leads to an improved thermal transfer from the corrugated ribs to the medium to be heated. With otherwise the same components the thermal conduction is increased by at least 5%. With more than two corrugated-rib elements provided one behind the other on different levels preferably each of the consecutively following corrugated-rib elements is arranged offset to the one in front in the direction of flow.

Furthermore, all corrugated-rib elements are preferably provided such that their corrugated ribs are overall each offset to one another.

Due to the appropriate measure a very effective thermal transfer between the corrugated-rib elements and the medium to be heated is produced in a layer of the layer structure, which is normally formed by elements with identical function of the heating block, which are arranged exactly one behind the other in the passage direction of the medium to be heated. Here, the formulation of the application request is being led by the impression that the medium passes at right angles through the frame to those areas which form the openings for the passage of the medium to be heated.

The frame here is normally formed by an embodiment, which surrounds the layer structure at least on both face sides, preferably fully circumferentially, whereby sides extending at right angles to this circumferential surround however form one or several sufficiently large openings, which normally leave the corrugated-rib elements completely or at least mainly free, so that they can be fully or almost fully subjected to the flow of the medium to be heated. The openings can be reinforced by lateral or longitudinal struts. Longitudinal struts here normally extend parallel to the layers of the layer structure and often at the height of the heat generating elements, whereas lateral struts extend at right angles to this and are used for mechanically stiffening the frame, in particular when—as with a preferred embodiment of the present invention—the heating block or layer structure is held in the frame under tension by one or several springs integrated into the layer structure, so that the elements of the layer structure are only located adjacent to one another by the clamping force of the spring element. This clamping force on one hand gives a good electrical contact between the parallel contact plates and the PTC element(s) arranged between them and on the other hand it gives a good thermal contact between the heat emitting elements and the corrugated-rib elements abutting them and pressed against them by the spring force.

In view of the most economic manufacture possible the layer structure of the electrical heating device is formed from identical elements in each case. If several heat generating elements are parts of the layer structure, they are identically formed in each case. Also, the corrugated-rib elements provided one behind the other in one level and the corrugated-rib elements stacked one above the other in the layer structure, optionally with an intermediate location of a heat generating element, are identically formed in each case. Depending on the specified heating power, the corrugated-rib elements can also each have a different thickness, i.e. extension in the flow direction of the medium to be heated so that for the required heating power in each case the optimum size is provided, particularly the thickness of the heating block. Normally, the heat generating elements assigned in each case to the corrugated-rib elements are formed according to the thickness of the corrugated-rib elements.

Here, normally two corrugated-rib elements are located on one heat generating element on different sides. Consequently, according to the invention normally at least four corrugated-rib elements abut one single heat generating element. This heat generating element does not necessarily have to be manufactured as a uniform heat generating element, whereby an appropriate embodiment is to be preferred. This means that with a uniform heat generating element all PTC elements are provided in a uniform positional frame, which on the top and bottom sides has contact plates to which the corrugated-rib elements directly or indirectly abut. Therefore, on one side of the heat generating element corrugated-rib elements corresponding to the number of corrugated-rib elements provided one behind the other in the flow direction abut directly or preferably indirectly separated by an insulating layer, e.g. of a plastic film and/or a ceramic layer, on the contact plates provided there. This applies correspondingly to the oppositely situated side.

The heat generating elements provided in the upward direction adjacent to one another are preferably spaced from one another by two identically formed corrugated-rib elements. In other words the distance in height of adjacent heat generating elements corresponds to twice the height of the corrugated-rib element.

According to a preferred embodiment of the present invention the corrugated-rib elements arranged one behind the other in the flow direction are each assigned to separate PTC elements. Here, the individual corrugated-rib elements define a layer, i.e. those corrugated-rib elements provided in the passage direction strictly one behind the other are therefore each arranged in levels one behind the other. A corresponding level normally has approximately the corresponding dimension of a thickness of the corrugated-rib element in the passage direction. Within these individual levels the PTC elements assigned to each corrugated-rib element are assigned. Here, this involves the PTC elements of a uniform layer, i.e. those PTC elements which are provided in the passage direction strictly one behind the other. With this further development an embodiment is specified in which corrugated-rib elements are arranged in one level of the layer structure and adjacently in the high direction and in which various layers of corrugated-rib elements sandwich in between in each case the PTC element(s) assigned to these corrugated-rib elements. The corresponding PTC elements here are normally located within the front and rear sides given by the corrugated-rib elements, whereby in a first approximation it is without further ado plain that these front and rear sides of all corrugated-rib elements of a level essentially concur. The PTC elements are accordingly located within an envelope surface, which is defined by the two corrugated-rib elements assigned to the PTC element. Preferably the envelope surface is solely defined by the corrugated ribs of these corrugated-rib elements. In the sectional view the PTC elements are always accordingly located between the corrugated-rib elements assigned to them, by means of which a thermal interaction between the corrugated ribs and the heat generating elements provided on the various levels is prevented.

According to a preferred further development of the present invention the PTC elements are arranged in a uniform heat generating element extending over several levels. Accordingly, the several corrugated-rib elements provided in various levels only bridge partial regions of this uniform heat generating element assigned to these corrugated-rib elements. The heat generating element accordingly has in the width direction, i.e. passage direction of the medium to be heated, an extension, which corresponds to a multiple of the width of one of the corrugated-rib elements corresponding to the number of the corrugated-rib elements provided one behind the other in the flow direction. Accordingly, corrugated-rib elements can be used for electrical heating devices of different heating power in an identical way. In each case identical corrugated-rib elements are provided, irrespective of whether heat generating elements are only provided in one or several levels. The adaptation of the corrugated-rib elements to the required heating power only occurs through displacement of the normally elongated corrugated-rib elements relative to one another so that the corrugated ribs of the corrugated-rib elements are offset to one another. In comparison the heat generating elements are directly adapted to the required heating power. An electrical heating device with corrugated-rib elements only provided in two levels has accordingly one heat generating element which extends over these two levels in the passage direction of the medium to be heated, whereas an electrical heating device equipped with three corrugated-rib elements provided in one layer one behind the other has a heat generating element, which corresponds in width to three times the width of the corrugated-rib elements so that these corrugated-rib elements can be brought three in a level into abutment on the uniform heat generating element.

With a view to further simplification for production the corrugated-rib elements are provided on one side with covering elements. On one face side these covering elements cover the bent region of a meander-type sheet metal strip essentially normally forming the corrugated-rib element. The covering elements can also lightly grasp the corrugated ribs at the edge on their front and rear sides and be joined frictionally or positively locked to the corrugated ribs by bending.

According to the preferred further development, the heat generating element is provided on one side with a sheet metal cover bridging the contact plates. Normally, on this side of the heat generating element the bent ends of the meander-type sheet metal strip of the corrugated-rib element directly abut the sheet metal cover. On the oppositely situated side of the heat generating element the covering elements provided on the corrugated-rib elements preferably indirectly abut the heat generating element contact plate provided there and namely preferably with the intermediate positioning of an insulating layer. Thereafter the pressure force applied point by point at these places on clamping the layer structure in the frame is equalised by the sheet metal cover on one side and the covering element on the other side. An equalisation of this nature is particularly advantageous if an insulating layer is provided between the contact plates and the sheet metal cover or the covering element, so that the corrugated-rib elements are provided potential-free in the electrical heating device and are not just electrically connected by the electrical strip conductors to the PTC elements.

With a view to obtaining the best possible scaling of the electrical heating device, which facilitates a modular construction and therefore an economical manufacture of electrical heating devices with different heating powers, a frame is suggested with the present invention for an electrical heating device. This frame and its further developments also further form the electrical heating device as such.

The frame has two frame elements forming the openings and at least one frame intermediate element arranged between them. These elements of the frame, i.e. the frame elements and the at least one frame intermediate element, can be joined together by mutually engaging latching lugs so that, for example, for preassembly the frame intermediate element can be permanently assigned to one of the frame elements by latching and the frame can be closed overall by latching. The latching elements are however formed such that the frame can be formed and closed by the frame elements alone. In a kit system of this nature several frame intermediate elements can, of course, be inserted, which are each formed identically and which in each case can be joined to the two frame elements by latching. The frame according to the invention is furthermore formed such that through the frame elements alone a frame can be formed, which forms in the passage opening of the medium to be heated an accommodation space for the layer structure in which it can be accommodated, provided the layer structure in a generally known manner only has one level of corrugated ribs and heat generating elements. A layer structure of this nature is located in the said accommodation space essentially in the passage direction, by means of which a compact construction is produced in this direction. The frame according to the invention is furthermore developed such that with a frame formed from the frame intermediate element an accommodation space, which as a rule is formed for the exact accommodation of a layer structure with several levels of corrugated ribs and heat generating elements, is formed extending in the passage direction of the medium to be heated. Also a layer structure of this nature formed from several corrugated-rib elements arranged one behind the other in a layer in the passage direction is accordingly basically fitted in this thus formed frame in the passage direction. Both frame arrangements accordingly facilitate a compact and space-saving accommodation of the relevant layer structure. The frame elements can be used identically in each case, irrespective of how many corrugated-rib elements are arranged in a layer one behind the other in various levels. This widening of the layer structure is just covered by the frame intermediate element. Here, a single frame intermediate element normally widens the accommodation space exactly by the width amount contributed by one corrugated-rib element arranged in a further level.

According to a preferred further development the frame elements are each formed identically, i.e. they can be manufactured in a single injection mould and joined by being rotated by 180° relative to another. If several frame intermediate elements form the frame, they are also preferably formed identically. The outer sides of the frame elements and of the frame intermediate element preferably have a retaining element part. This retaining element part protrudes beyond the outer side and is formed such that on a frame solely formed by the frame elements and on a frame formed by the frame elements and the frame intermediate element a retaining element is formed by interacting retaining element parts. The retaining element part accordingly and normally just forms the half of a complete retaining element. The retaining element part can in particular be formed hook-shaped and namely such that after the joining of the elements forming the frame by mutually interacting retaining element parts, a hole is enclosed in which a mounting screw can be fitted, for example, in order to attach a mounting flange and/or a housing of a control device for the electrical heating device to the face side of the frame.

BRIEF DESCRIPTION OF THE DRAWINGS

Further details and advantages of the present invention are given in the following description of embodiments in conjunction with the drawing. Here, the drawing illustrates the basic construction of an electrical heating device into which a heat emitting element is built, which itself can be solely essential to the invention. The drawing shows the following.

DETAILED DESCRIPTION OF THE PREFERRED EMBODIMENT

Figure 1:
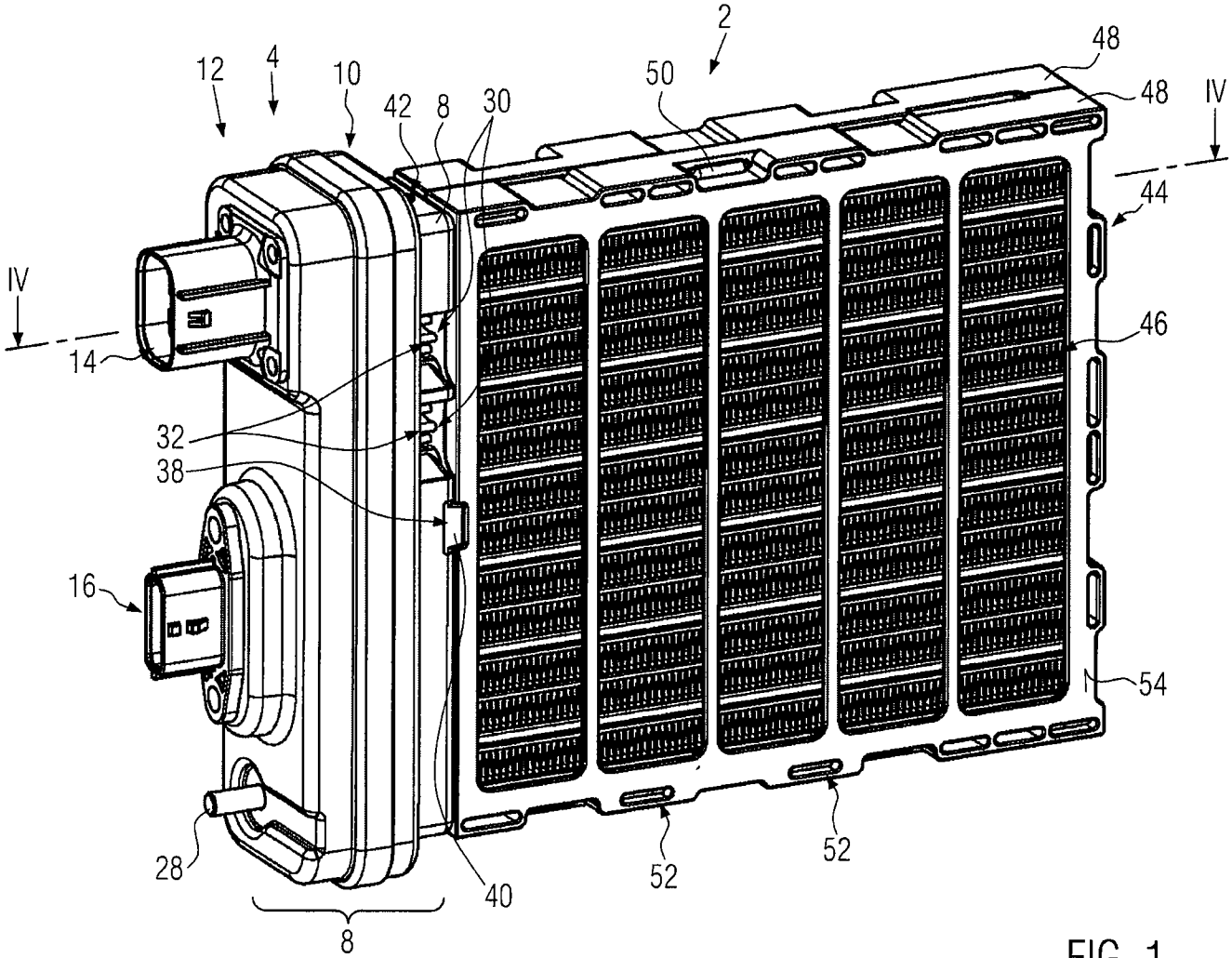
FIG. 1 a perspective side view of an embodiment of an electrical heating device for a motor vehicle.

FIG. 1 illustrates an embodiment of an electrical heating device with a power section labelled with the reference numeral 2 and a control section labelled with the reference numeral 4. The power section 2 and the control section 4 form a constructional unit of the electrical heating device.

Figure 4:
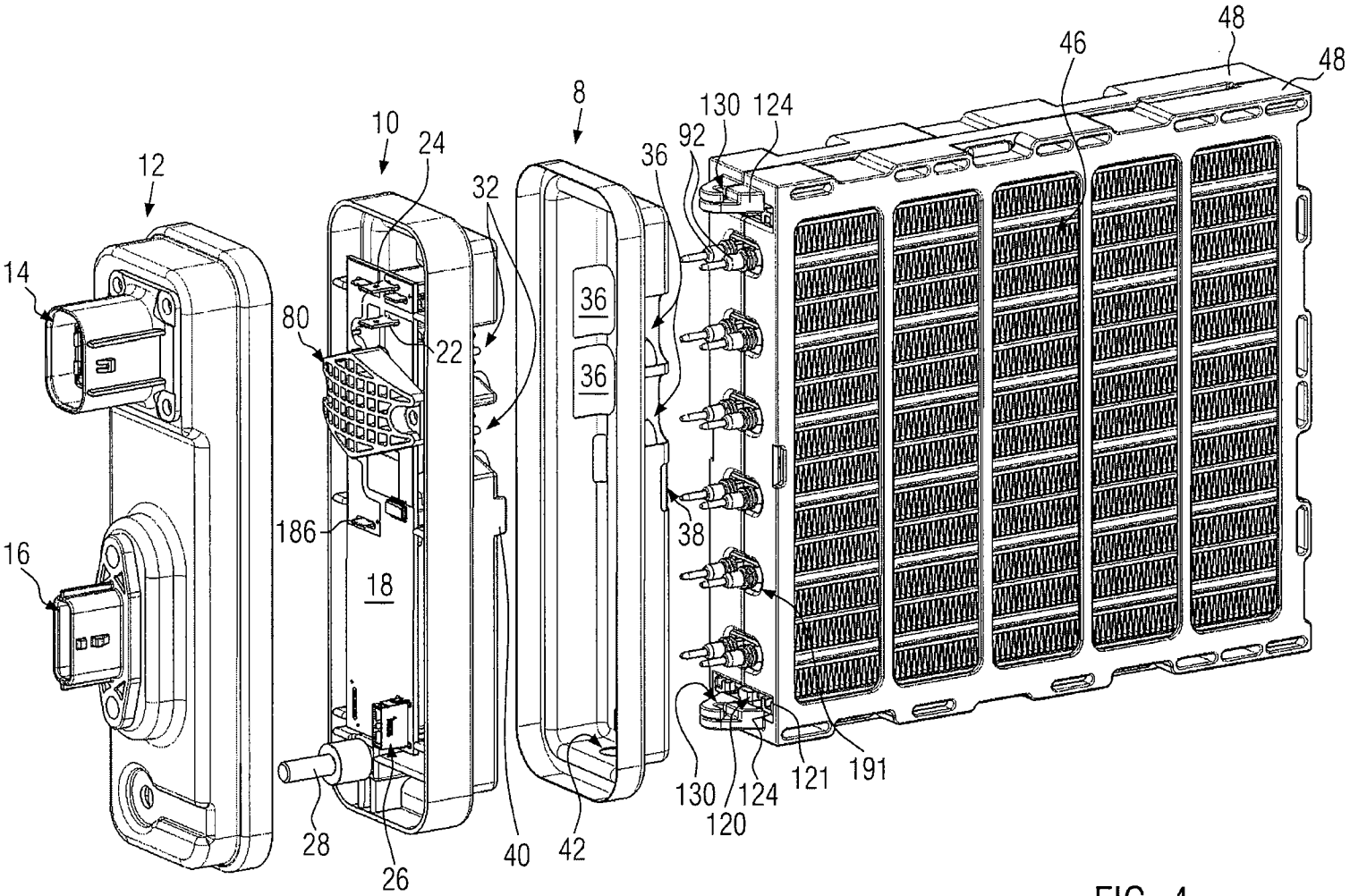
FIG. 4 a perspective side view of the embodiment illustrated in FIG. 1 in an exploded view of the main constituent parts of the embodiment.

The control section 4 is formed on the outside by a connecting housing 6, which—as shown particularly in the illustration according to FIG. 4—consists of a screening housing 8, which is formed as, for example, a deep-drawn or cast, respectively deep-drawn metal shell, a plastic housing element 10, which is inserted into the metal shell 8 and a housing cover 12. In the joined state the housing cover 12 can grasp over a free flange of the sheet metal cup 8 and be formed of metal so that the interior of the control section 4 is completely screened by a metallic connecting housing 6. The housing cover 12 can however also be formed from plastic.

The housing cover 12 bears a female plug housing 14 for the power current and a further female housing element which is formed as a control plug housing 16. Both plug housings 14, 16 are joined as plastic elements to the metallic housing cover 12 and form guide and sliding surfaces for in each case a male plug element which is not illustrated.

The plastic housing element 10 accommodates a conductor board 18 within it which is partially covered by a pressure element 20 which is explained in more detail in the following. The conductor board 18 has a plus connecting contact 22 and a minus connecting contact protruding over it, which lie exposed in the power plug housing and are electrically connected to the strip conductor. The conductor board 18 furthermore bears a control contact element 26 which contains control element contacts and which can be reached by lines via the control plug housing 16. As can be seen from FIG. 4, the control plug housing 16 is arranged offset to the control contact element 26. This distance is required due to the installation situation of the electrical heating device in the motor vehicle. The electrical contacting between the control contact element 26 and the control plug housing 16 or the contact elements provided there occurs through the electrical leads which are routed inside the housing cover 12. Furthermore, in the assembled state the housing cover has a connecting bolt 28 protruding over it for the ground connection which is electrically connected to the screening housing 8.

Figure 5:
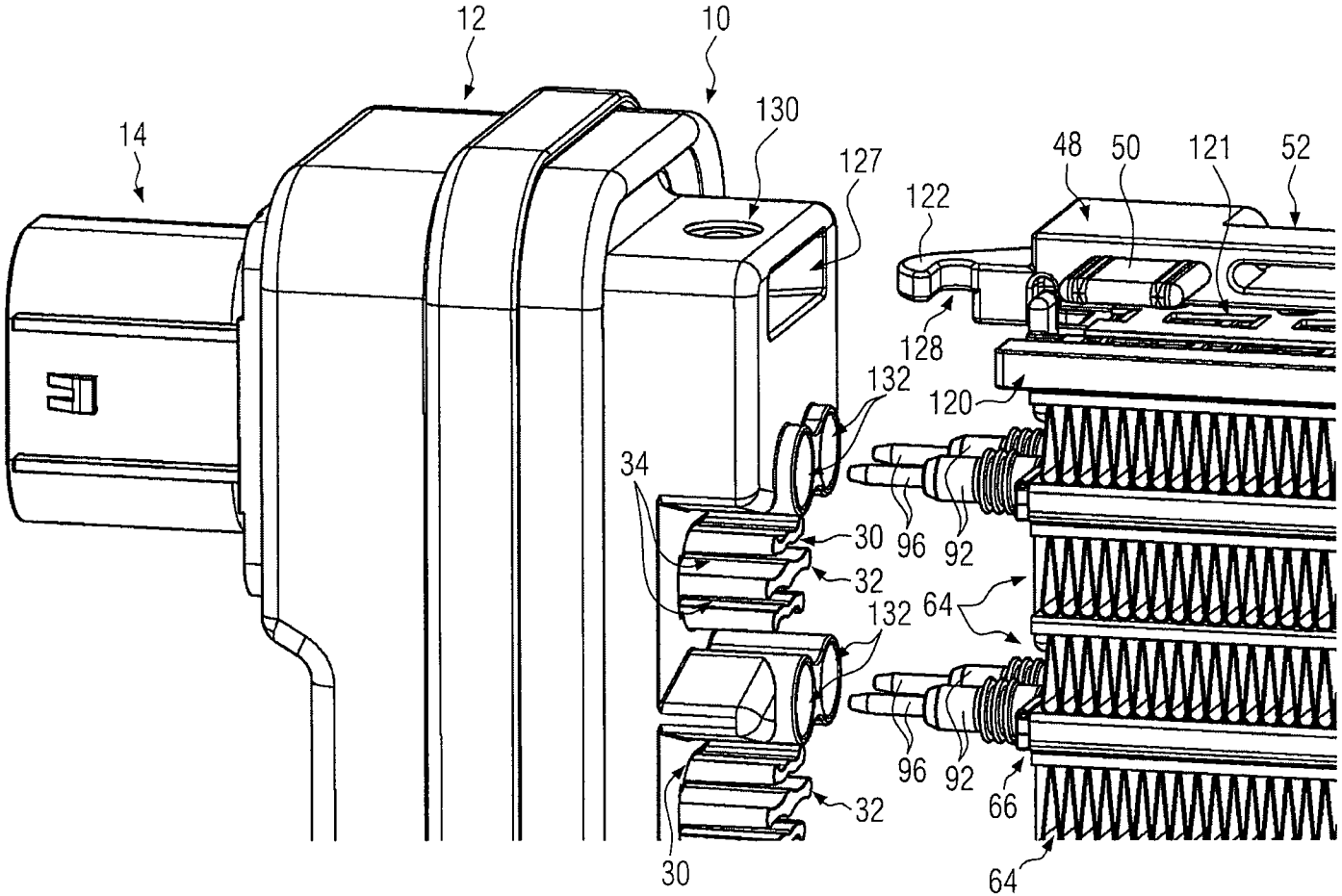
FIG. 5 a joining region between a connecting housing and a layer structure of the embodiment of an electrical heating device illustrated in FIGS. 1 and 4 with the omission of various elements.

On the end side oppositely situated to the conductor board 18 the plastic housing element 10 forms two cooling channels 30 for heat sinks 32 which are only indicated in FIG. 4, but can be recognised more clearly in FIGS. 1 and 5. The free end of the heat sinks 32 comprises several cooling ridges extending essentially parallel to one another which define in each case air passage channels 34. The heat sinks 32 are made of a good thermally conducting material, for example aluminium or copper.

The omitted sheet metal shell 8, which is not illustrated in FIG. 5, has, as elucidated in particular in FIGS. 1 and 4, corresponding to the cooling channels 30, oppositely situated passage openings 36 for air which are provided as entry and exit openings for the cooling channels 30. These passage openings 36 are formed in the metal shell 8. At about central height in the longitudinal direction the metal shell 8 has latching openings 38, through which after the final assembly of the control section 4 on the power section 2 latching lugs 40 penetrate, which are positively locked in engagement with the power section 2 and formed on the outer edge of the plastic housing element 10 (cf. FIG. 1). On oppositely situated face sides the metal shell 8 also has in each case mounting holes 42 which will be dealt with in more detail in the following (cf. FIG. 4).

The power section 2 has a frame 44 which is circumferentially enclosed in the embodiment according to FIG. 1 and circumferentially surrounds a layer structure labelled with the reference numeral 46 which is also designated as a heating block. The frame 44 is formed from two frame elements 48, which are latched together by latching connections which are labelled with reference numeral 50 (male latching element) and reference numeral 52 (female latching element), in particular in FIG. 16.

On oppositely situated outer sides 54 the frame 44 forms in each case openings 56 for the passage of air to be heated by the air heater illustrated in the embodiment. In the illustrated embodiment these openings 56 are stiffened by lateral struts 58, which join oppositely situated side edges of the frame 44.

In its interior the frame 44 defines an accommodation space 60 which is adapted such that the layer structure 46 can be accommodated closely fitted in the frame 44.

Figure 10:
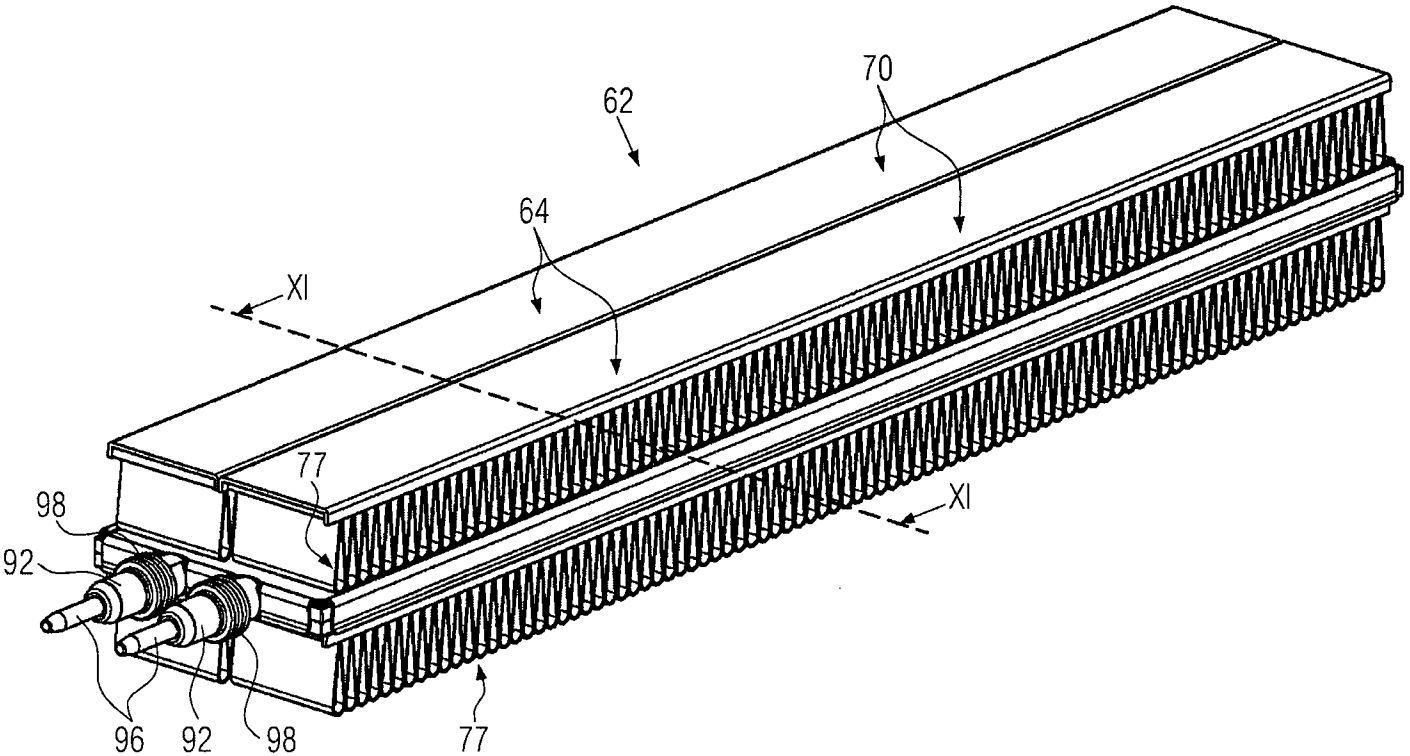
FIG. 10 a perspective side view of a first embodiment of a heating bar which can be built into the electrical heating device according to FIG. 1.
Figure 13:
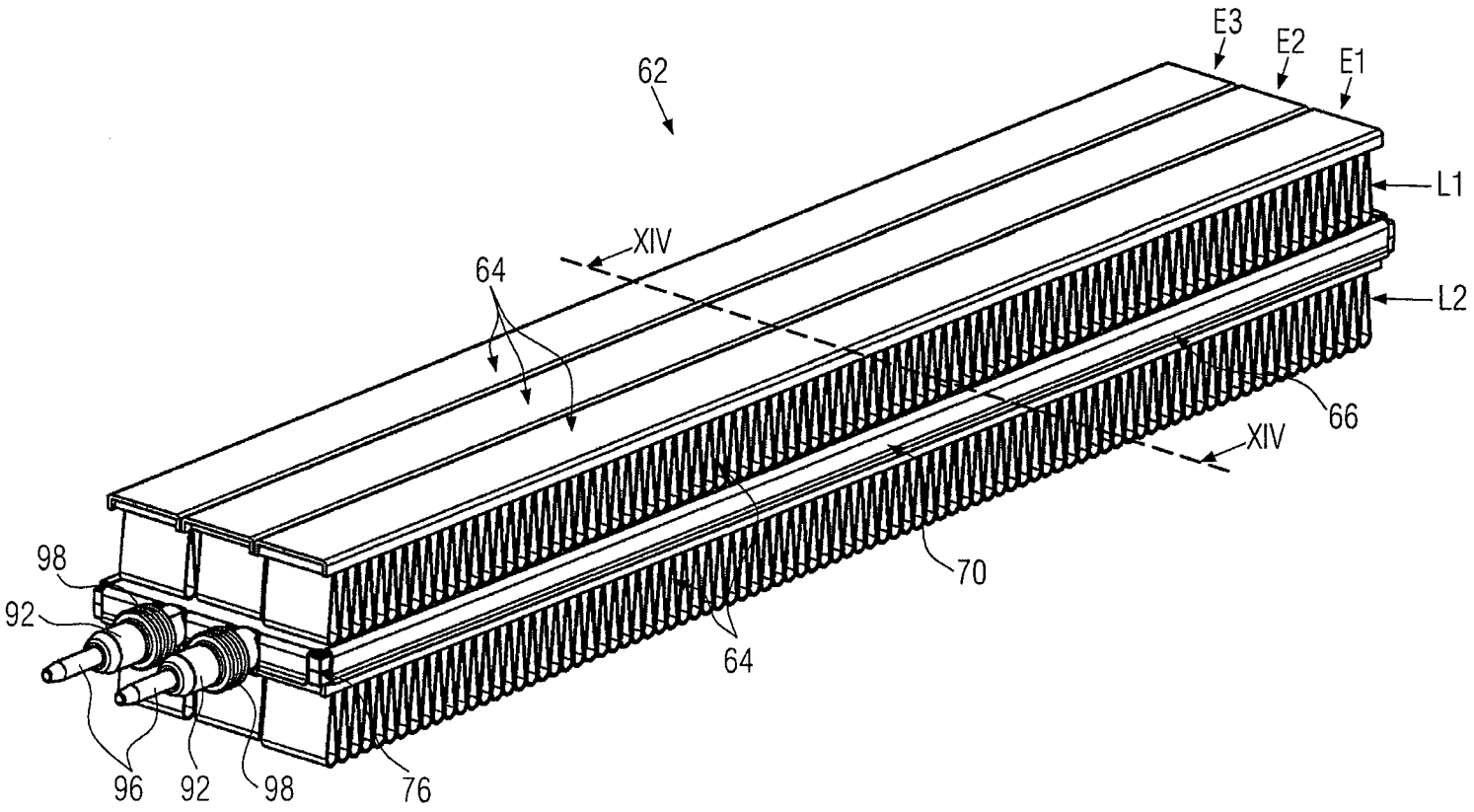
FIG. 13 a perspective side view according to FIG. 10 onto an alternative embodiment of a heating bar.

The heating block or layer structure 46 is essentially formed by the heating bars 62 which are illustrated in FIGS. 10 and 13 and which are arranged one above the other layered in the receptacle 60. The heating bars 62 consist of at least two corrugated-rib elements 64, which accommodate a heat generating element 66 between them. As FIGS. 10 and 11 elucidate, the corrugated-rib elements consist of meander-type, bent sheet metal strips 68, which are covered on one side by a sheet metal cover 70 and grasped at the edge by a bent edge 72 of the sheet metal cover 70. The respectively other upper side of the meander-type bent sheet metal strips 68 is free and is directly formed by bent free ends 74 of the sheet metal strip 68. With the heating bar 62 illustrated in FIGS. 10 and 11 in the passage direction of the air to be heated, i.e. at right angles to the surface of the frame 44 clamped by the outer sides 54, two corrugated-rib elements 64 are provided in each case adjacently. This arrangement of corrugated-rib elements 64 provided one behind the other in the flow direction forms a layer. Here, in each layer labelled with the reference letter L one corrugated-rib element 64 is provided in each case per level E. S indicates the flow direction of the air flow to be heated in FIG. 11. Accordingly, this first meets the first level E1, i.e. the corrugated-rib elements 64 of the first layer L1 and the second layer L2 provided in the first level and only thereafter the corrugated-rib elements 64 provided in the second level E2. The corrugated-rib elements 64 are here arranged in the flow direction S, i.e. strictly one behind the other at right angles to the outer side 54 defining the opening 56. Here, the heat generating element 66 forms a flat contact base for the corrugated-rib elements 64.

Figure 2:
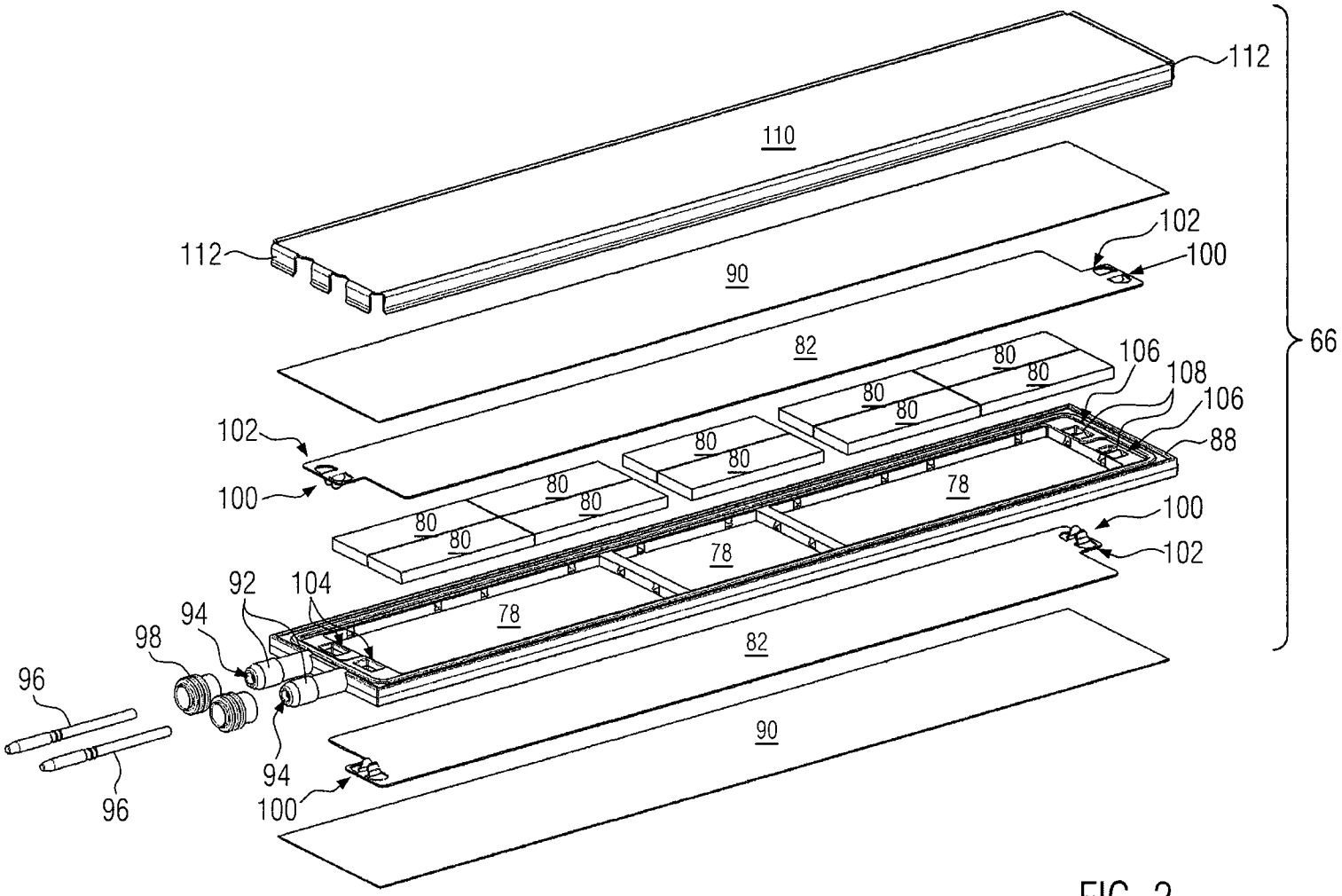
FIG. 2 a perspective, exploded side view of a heat generating element of the electrical heating device illustrated in FIG. 1.

As can be seen especially from FIG. 2, the heat generating element 66 consists of several layers lying one above the other. The heat generating element 66 is essentially constructed symmetrically, whereby a positional frame labelled with the reference numeral 76 and made from an electrically insulating material, in particular plastic, is provided in the centre. The positional frame 76 forms in the present case three receptacles 78 for PTC elements 80. Several, at least two, PTC elements 80 are accommodated in a receptacle 78. Both outer receptacles 78 each accommodate four PTC elements 80. Contact plates 82 abut oppositely situated sides of the PTC elements 80. These two contact plates 82 are formed identically and punched out from electrically conducting sheet metal. The contact plates 82 are placed on the PTC elements 80 as separate elements, with the positional frame 76 or at least the receptacle of the positional frame 76 sandwiched in between the contact plates 82. They can be additionally provided with a vapour deposited electrode layer, as generally normal. The electrode layer is however not a contact plate 82 for the purpose of the invention.

Figure 11:
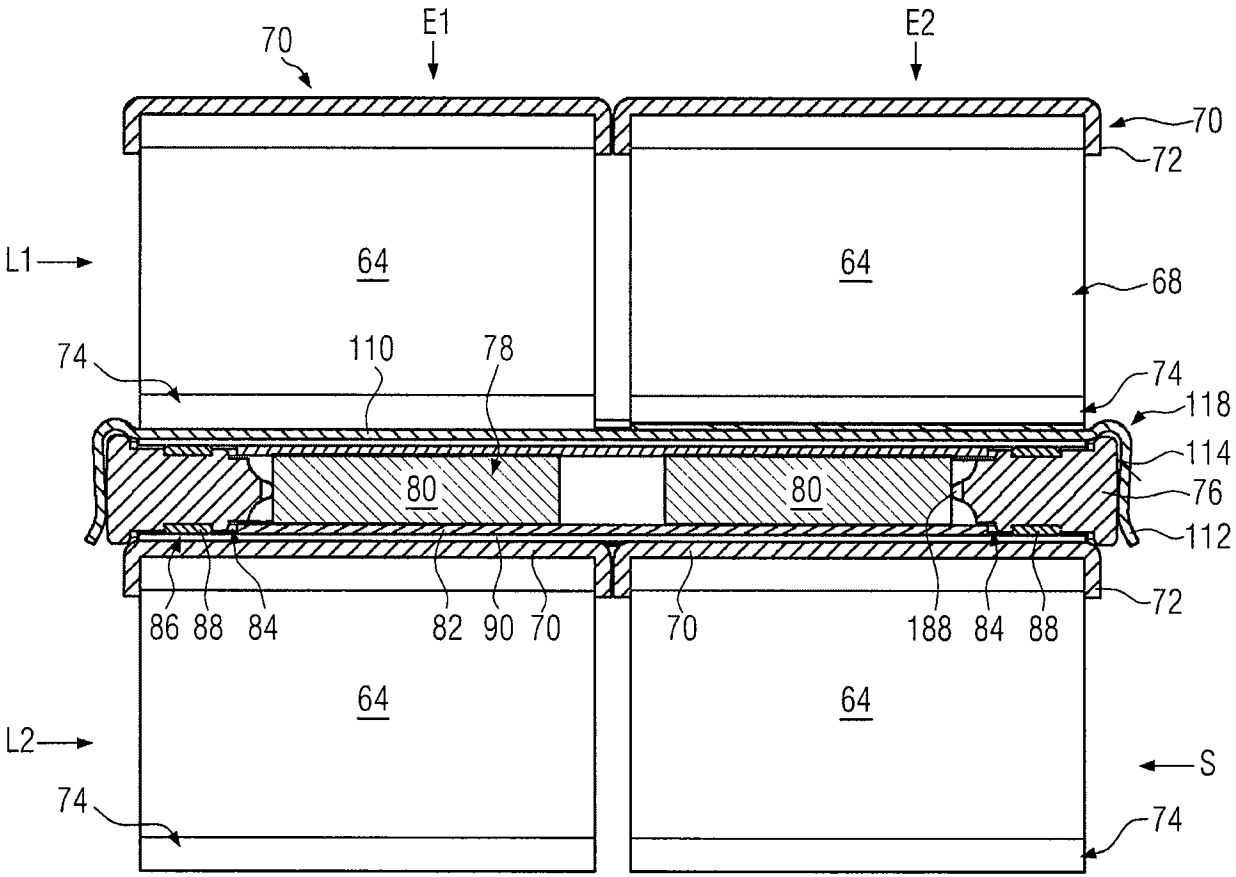
FIG. 11 a cross-sectional view along the line XI-XI according to the illustration in FIG. 10.

As FIG. 11 particularly shows, the PTC element 80 assigned to a level E1 is located within the front and rear sides of the assigned corrugated-rib elements 64. In other words there is no PTC element 80 located between two corrugated-rib elements 64 provided in one layer L1. In this way a thermal interaction between the PTC elements of different levels E1, E2 is avoided.

The contact plates 82 are dimensioned such that they are accommodated within the positional frame 76, but are arranged circumferentially with a spacing to the positional frame 76. The circumferential gap so formed is labelled with the reference numeral 84 in FIG. 11. At approximately the height of the contact plates 82 the positional frame 76 forms a circumferential sealing groove 86 into which elastomeric adhesive edging 88 is filled as annular beading. This adhesive edging 88 surrounds all the receptacles 78 fully circumferentially and is used for the adherence of an insulating layer with the reference numeral 90, which in the present case is formed from an insulating plastic film and which extends up to a marginal region of the positional frame 76, in any case in the circumferential direction protruding over the adhesive edging 88 with excess. Due to joining the insulating layer 90 with the positional frame 76, facilitated by the adhesive edging 88, the receptacle 78 and the contact plates 82 are hermetically sealed with respect to the outer circumference.

Access to the interior of the positional frame 76 is solely given on the face side of the positional frame 76 and by connection pieces 92 which are formed as one part from its material and which fully circumferentially surround a channel 94 for accommodation of pin-shaped contact elements 96. On their free ends the connection pieces 92 bear sealing elements 98, formed from a thermoplastic elastomer or from PTFE, with a labyrinth type of sealing structure, which can be joined to the associated connection pieces 92 by overmoulding or plugging on. On the face side of each positional frame 76 two connection pieces 92 with identical embodiment and sealing are provided for the accommodation of two contact pins 96 for electrically contacting the contact plates 82.

As can be furthermore taken from FIG. 2, the contact plates 82 have female clip element receptacles 100, manufactured by means of punching and bending, which are formed on sidewards offset protrusions 102 of the contact plates 82, the said protrusions 102 terminating within the circumferential edge provided by the adhesive edging 88 and bridging in each case assigned clip openings 104, 106 formed by the positional frame 76. In the clip openings 106, formed opposite the connection pieces 92 on the positional frame 76, clip ridges 108 are provided, formed with the material of the positional frame 76 as one part. The embodiment and the diameter of these clip ridges 108 correspond to the diameter of a contact pin 96. The contact pins 96 lie exposed in the clip openings 104 and are joined to the female clip element receptacles 100 of the contact plates 82, whereas on the opposite side the female clip element receptacles 100 protrude into the clip openings 106 and are latched with the clip ridges 108. On the connection side of the heat generating element 66 exhibiting the connection pieces 92 the described clip connections can be realised either by positioning the contact plates 82 in their installation position, followed by insertion of the contact pins 96 through the channels 94, or by latching the female clip element receptacles 100 to the contact pins 96 which are already located in position.

On its upper side illustrated in FIG. 2 the heat generating element 66 is provided with a sheet metal cover 110. This sheet metal cover 110 covers the complete insulating layer 90 assigned to the sheet metal cover 110 and has a circumferential edge 112, which frictionally abuts a circumferential marginal area 114 of the positional frame 76 and accordingly secures the sheet metal cover 110 to the positional frame 76 by a clamping force (cf. also FIG. 11). Furthermore, due to the edge 112 exact positioning of the sheet metal cover 110 relative to the external circumference of the positional frame is ensured. At the free end of the edge 112 the sheet metal cover 110 slightly widens conically, which acts as a funnel-shaped insertion opening for the positional frame. The circumferential edge 112 is only penetrated in the corner regions and at the height of the connection pieces 92 and forms a one-sided screen for the heat generating element 66.

Figure 3:
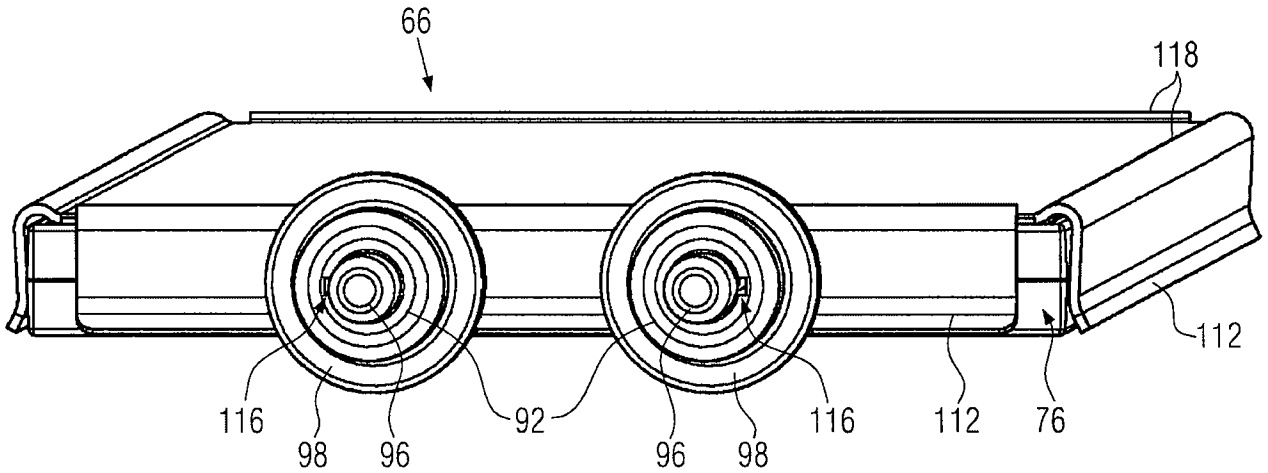
FIG. 3 a perspective face-side view of the embodiment illustrated in FIG. 2.

As FIG. 3 illustrates, the channels 94 formed to match the contact pins 96 are widened radially for the formation of a groove-shaped inspection channel 116. This inspection channel 116 extends from the front free face side of the connection pieces 92 up to the assigned clip opening 104 and accordingly forms an external access to the receptacles 78, which communicate with one another below the insulating layer 90 or the contact plates 82.

As FIG. 3 furthermore illustrates, the sheet metal cover 110 forms a flat contact base between the slightly upwardly bent lip regions 118 for the circumferential edge 112. These lip regions 118 accordingly give a type of centring for the corrugated-rib elements 64 abutting the sheet metal cover 110 (cf. also FIG. 11).

In the illustrated embodiment the previously described layer structure 46 is held in the frame 44 under spring tension. For this purpose the frame 44 has spring insertion openings 120, formed by the two frame elements 48, which can be seen in FIGS. 4 and 5 and which, with the auxiliary heater not yet assembled, are exposed on the face side on the controller side of the power section 2. In these spring insertion openings 120 spring elements 121 are inserted for clamping which are described in EP 2 298 582 originating from the applicant and its disclosure content is included in the disclosure of the present application through this reference. Directly adjacent to these spring insertion openings 120, each of the frame elements 48 forms a retaining element part 122. Each retaining element part 122 formed by a frame element 48 is given an oblique ramp surface 124. The retaining element parts 122 are formed such that with joined frame 44 two retaining element parts 122 assigned in each case to a frame element 48 form complete retaining elements 126 on oppositely situated end sides with the retaining element parts 122 of the other frame element 48. These retaining elements 126 have a tapering embodiment towards the free end, so that the oblique ramp surfaces 124 are used for coarse positioning of the control section 4, namely of a positioning opening 127 of the plastic housing element 10 relative to the power section 2 (cf. FIG. 5). Furthermore, after the joining of the frame elements 48 laterally extending grooves 128 on the retaining element parts 122 form a circumferentially closed hole 130 (cf. FIG. 4). A mounting screw can be fitted into this hole 130 through the mounting hole 42 of the metal shell 8 to provide the positioning and fixing of the power section 2 on the control section 4 to realise one constructional unit for the power section 2 and the control section 4.

Figure 6:
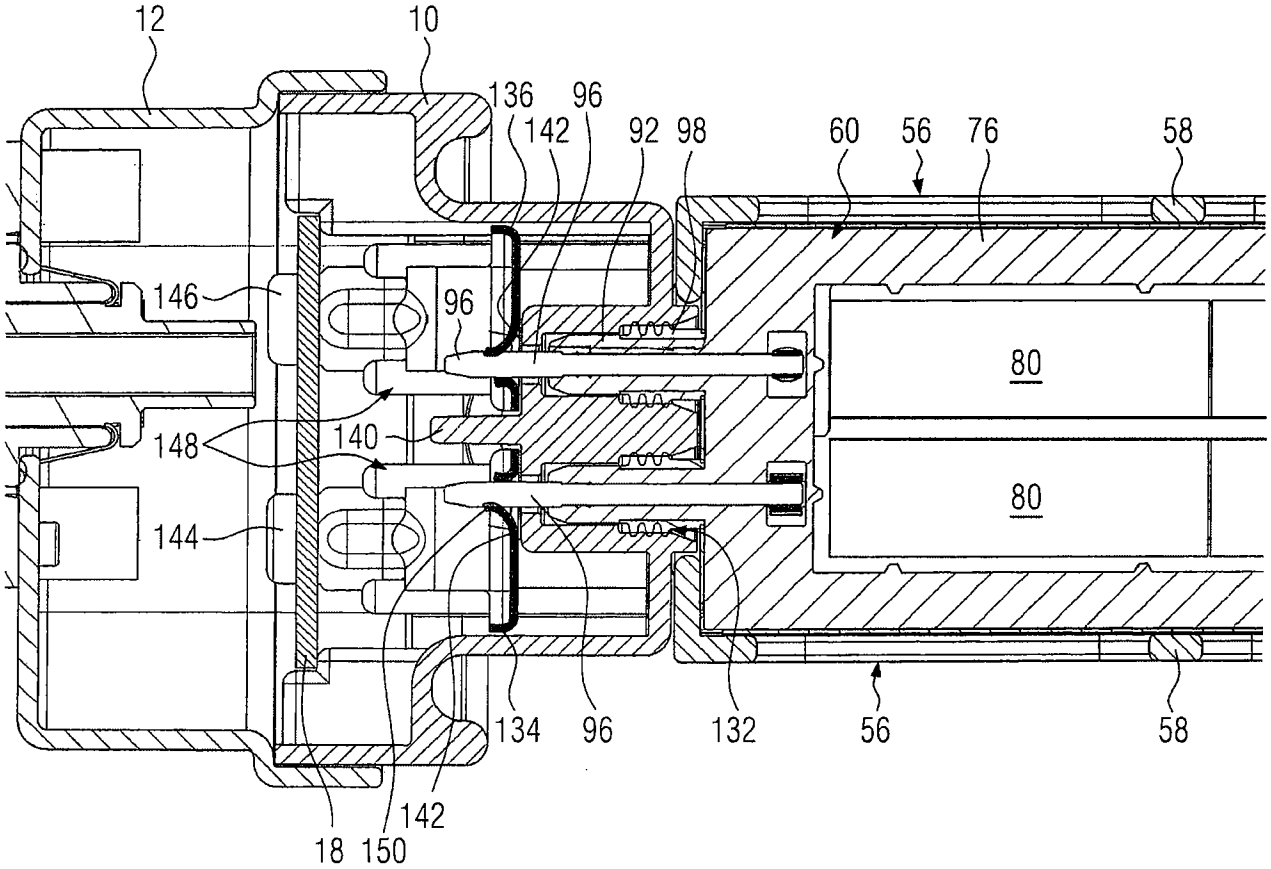
FIG. 6 a cross-sectional view along the line VI-VI according to FIG. 1, i.e. a sectional view through a heat generating element according to FIG. 2 at medium height of the same with omission of the screening housing.

As FIGS. 5 and 6 illustrate, the plastic housing element 10 for each heat generating element 66 forms two cylindrical sleeve receptacles 132 which are matched such that the connection pieces 42 together with the sealing elements 98 can in each case be introduced sealed into assigned sleeve receptacles 132. As FIG. 6 illustrates, the sleeve receptacles 132 are widened conically at the end and have initially a widened cylindrical section for accommodating the sealing element 98 and further inside there is a cylindrical section with a smaller diameter which retains the frontally conically tapering connection piece 92 with slight play and thus limits the deformation of the sealing element 98 after assembly.

Figure 7:
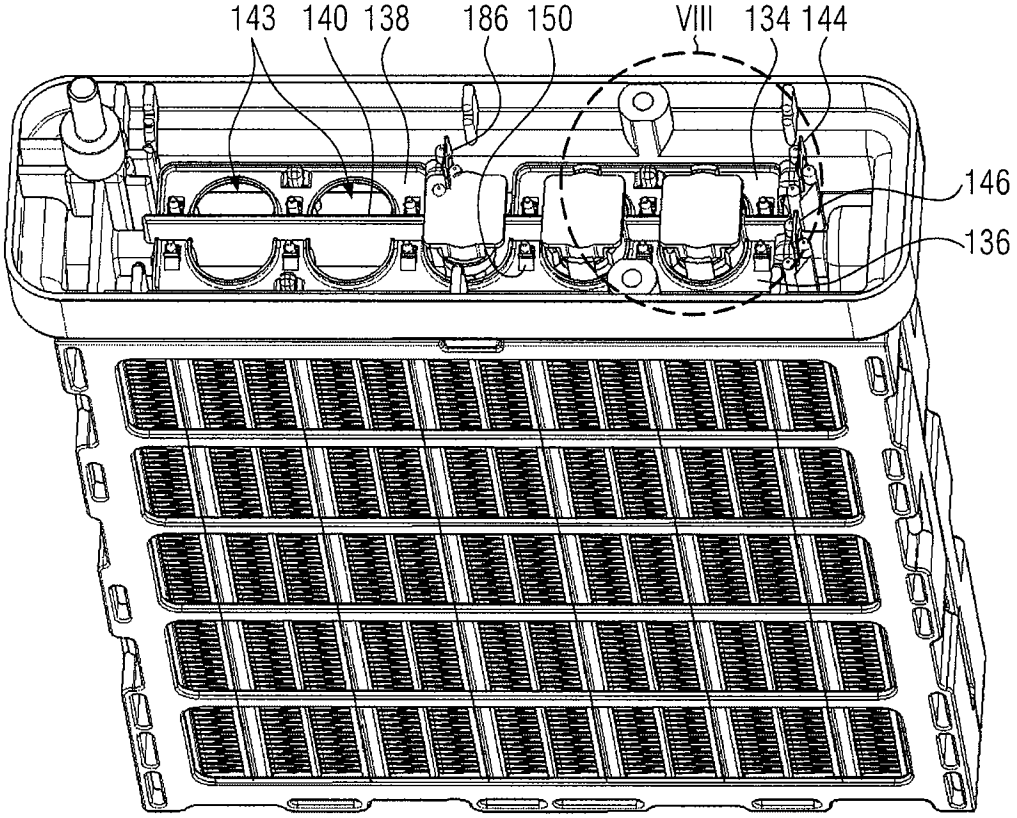
FIG. 7 a perspective face-side view of the embodiment illustrated in FIG. 1 of an electrical heating device, which gives a view into the connecting housing and in which the conductor board and the housing cover are omitted.

The contact pins 96 each penetrate contact surface elements 134 which are formed from sheet metal by punching and bending and which group several contact pins 96 of the same polarity within the connecting housing 6 so that they are assigned to a heating stage. The lower contact surface element is a first plus contact surface element 134, whereas the upper contact surface element is a minus contact surface element 136. As FIG. 7 particularly illustrates, the plastic housing element 10 accommodates a further, second plus contact surface element 138. The minus contact surface element 136 and the plus contact surface elements 134, 138 are separated from one another by a partition ridge 140. This partition ridge 140 protrudes over an abutment level formed by the plastic housing element 10 for the contact surface elements 134, 136, 138. These surfaces of the plastic housing element 10 defined by the abutment level are labelled in FIG. 6 with the reference numeral 142. Due to the ridge 140 the creepage current path between the contact surface elements 134, 138 of the plus polarity and the contact surface element 136 of the minus polarity is extended such that creepage currents between both contacts are not to be expected. Also the air clearance between the contact surface elements 134 and 136, respectively 138 and 136 is displaced. The contact surface elements 134, 136, 138 have semicircular recesses 143 open to the partition ridge 140 between the contact pins 96. In FIG. 6 contact tongues 144, 146 can be seen in each case, which penetrate the conductor board 18 and are formed as one part by punching and bending on the contact surface elements 134 and 136 and which are held raised in contact tongue retention regions 148 relative to the contact bases 142. These details can be seen in FIG. 8. As here illustrated, the respective contact surface elements 134, 136 have at their ends joining lugs 145 which open out into the contact tongues 144, 146. As can be seen furthermore from FIGS. 6 and 8, the contact surface elements 134, 136, 138 for the individual contact pins 96 have formed contact openings manufactured by punching and bending. Accordingly, oppositely situated contact projections 150 abut the external circumference of the contact pins 96 under elastic strain. As can be seen furthermore from FIG. 8, the plastic housing element 10 forms latching projections 152, which are introduced into the latching openings 154 of the contact surface elements 134, 136, 138, which are delimited on the opposite sides of sharp-edged clamping segments 156 of the sheet metal material forming the contact surface elements 134, 136, 138. These clamping segments 156 accordingly claw onto the latching projections 152 and fix the contact surface elements 134, 136, 138 onto the latching projections after being pushed on.

Figure 8:
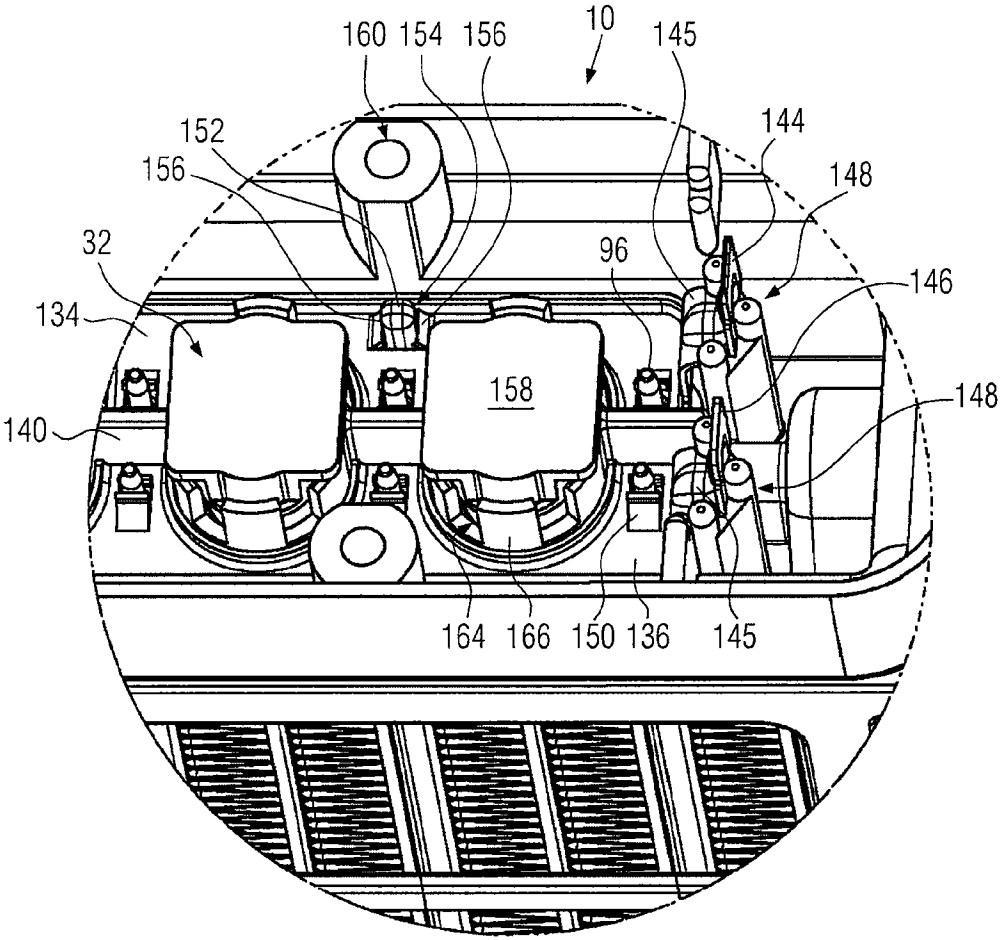
FIG. 8 the detail VIII drawn in FIG. 7 in an enlarged illustration.

FIG. 8 also shows the previously described heat sinks 32, which are exposed within the plastic housing element 10 and protrude over the partition ridge 140 on the upper side with a flat contact base 158.

Centrally between the heat sinks 32 and at the edge of the plastic housing element 10 mounting eyes 160 can be seen in each case for the previously generally mentioned pressure element 20. As particularly illustrated in FIGS. 4 and 9, this is formed honeycomb-shaped with a large number of honeycomb ridges 162 extending at right angles.

Figure 9:
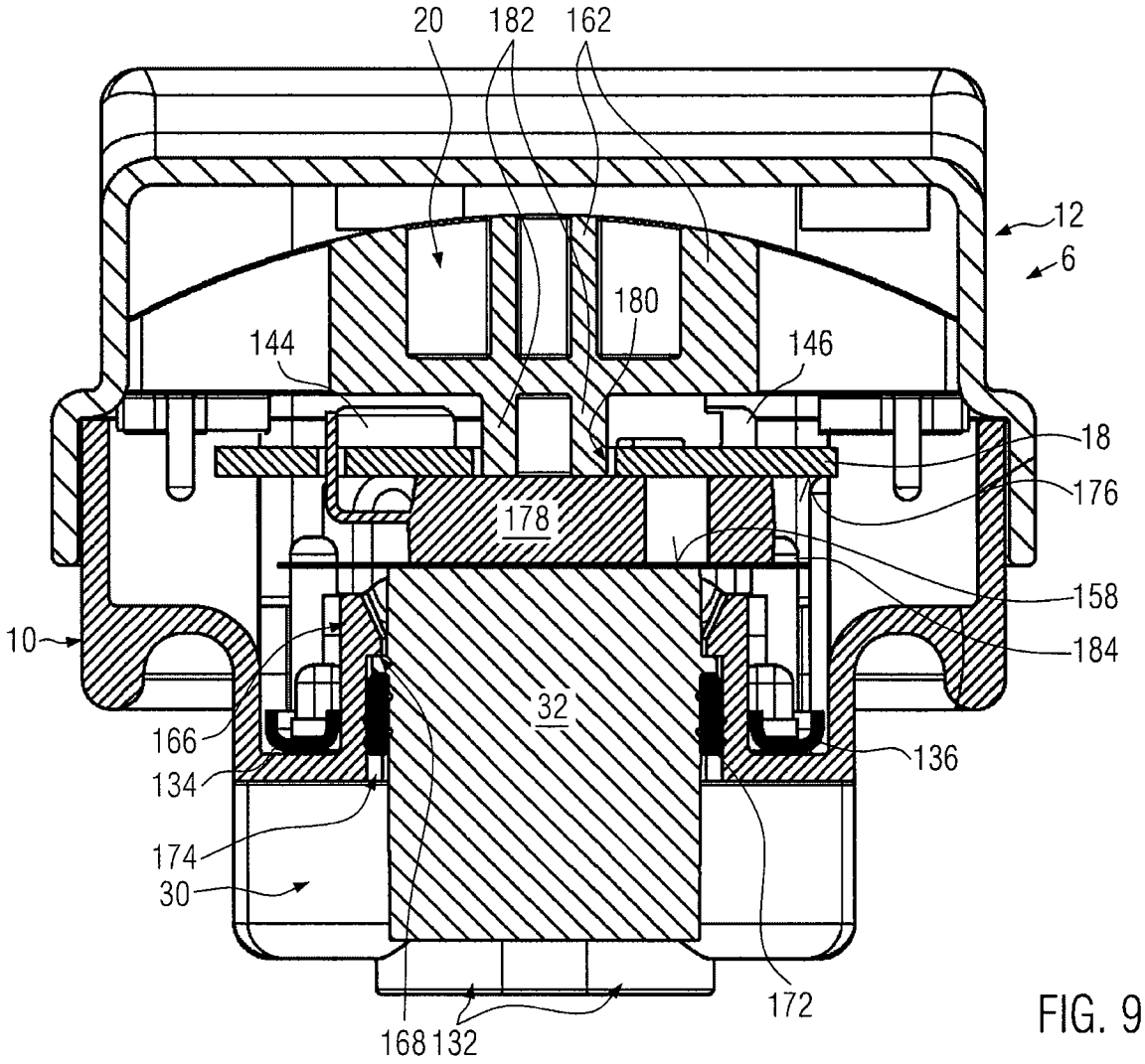
FIG. 9 a cross-sectional view of the connecting housing of the electrical heating device according to FIG. 1 at the height of a heat sink.

The sectional view according to FIG. 9 illustrates the installation of the heat sink 32 into the plastic housing element 10. As can be seen from FIG. 8, this has a large number of latching posts 166, provided distributed on the circumference of a raised heat sink insertion opening 164 of the plastic housing element 10, which constrict the heat sink insertion opening 164 conically at the edge and form latching shoulders 168, which grasp over a circumferential latching ridge 170 formed on the heat sink 32, thus frictionally preventing pressing out upwards and in the direction onto the connecting housing 6. The contour of the recesses 143 of the contact surface elements 134, 136, 138 corresponds to the contour of the heat sink insertion opening 164 so that its raised edge is closely delimited by the contact surface elements 134, 136, 138. The two plus contact surface elements 134, 138 are formed identically so that they can be alternatively used for the formation of the first or second contact surface element 134 or 138. On the side of the latching ridge 170 opposite the latching shoulder 168 there is a sealing element 172 which circumferentially surrounds the heat sink 32 and is supported on the underside facing away from the latching ridge 170 in the circumferential direction by ridges which cannot be discerned in FIG. 9, so that the sealing element 72 cannot slide in the direction towards the power section 2 through a sealing receptacle labelled with the reference numeral 174. This sealing receptacle 174 is formed in one piece with the plastic housing element and extends the heat sink insertion opening 164.

In FIG. 9 the sealing element is illustrated in an only slightly compressed embodiment. The sealing element 172 can however be compressed in the longitudinal direction of the sealing receptacle 174 in that sealing between the inner circumferential surface of the cylindrical sealing receptacle 174 and the external circumferential surface of the heat sink 32 is lost. The sealing element 172 can here be compressed by about 2/10 to 7/10 mm by displacement of the latching ridge 170 in the longitudinal extension of the sealing receptacle 174. The equalisation movement is applied by screwing the pressure element 20 onto the mounting eyes 160 after assembly of the conductor board 18, which is provided with two semiconductor power switches 178 on its underside 176 facing the heat sink 32. Each power switch 178 is located on the flat contact base 158 of the assigned heat sink 32. At the height of the power switch 178 the conductor board in each case has a hole 180, which is penetrated by pressure ridges 182 of the pressure element 20. These pressure ridges 182 directly abut the power switch 178 and press it against the heat sink 32. Since the power switch 178 may have substantial manufacturing thickness tolerances, the sealing element 172 provided in the embodiment facilitates an equalisation by the receding of the heat sink 32 in the direction towards the power section 2 without the sealing of the heat sink 32 in the plastic housing element 10 being lost. As can be taken from the overall view, in particular from FIGS. 4 and 9, after screwing against the plastic housing element 10 the pressure element 20 acts on both power switches 176 and presses each of them against the heat sink 32 assigned to them. Due to an insulating layer 184 placed on the contact base 158 of the heat sink 32, the power switch 178 is electrically insulated from the assigned heat sink 32. The insulating layer 174 is a ceramic insulating layer. Also this insulating layer 184 protrudes beyond the heat sink 32 to enlarge the creep path substantially in the width direction (cf. FIG. 9).

The contact surface elements 134, 136 contact the conductor board 18 through contact tongues 144, 146. A second plus contact tongue 186 (cf. FIG. 4) with the second contact surface element 138 protruding over it connects the heating circuit formed by the second plus contact surface element 138 and the minus contact surface element 136 to the conductor board 18 (cf. FIG. 4). As can be seen furthermore from FIG. 9, the semiconductor power switch 178 contacts the conductor board 18 and switches the power current to the associated circuit. In the present case two heating stages are realised, each of which can be switched and controlled through one of the semiconductor power switches 178.

Sealed Heat Sink

As previously described, the heat sink 32 is also retained sealed in the heat sink insertion opening 164. Here the embodiment, i.e. the one in FIG. 9, illustrates a situation in which the power switch 178 has the smallest thickness within the conceivable tolerance range. In this case the latching ridges 170 are located directly below the latching shoulders 168. Touching does not however take place, so that the compression force caused by the—even if only slight—compression of the sealing element 172 acts on the phase boundary between the heat sink 32 and the power switch 178. This power switch 178 in each case abuts on the underside 176 against the conductor board 18 independently of the thickness tolerance. With its pressure ridges 82 the pressure element 20 only relieves the conductor board 18 so that the power switch 178 is held clamped not through the conductor board 18, but rather only between the pressure element 20 and the heat sink 32 effecting the tension with the intermediate positioning of the insulating layer 184.

Correspondingly, the position of the power switch 178, the conductor board 18 and the pressure element 20 does not change with a power switch 178 having greater thickness. Rather, the heat sink 32 in the heat sink insertion opening 164 is forced in the direction towards the power section 2, so that the sealing element 172 compresses more while retaining the sealing of the heat sink 32 and—compared to the illustration in FIG. 9—the latching ridges 170 are arranged in a further lowered position, i.e. spaced further from the latching shoulders 168.

Defined Abutment Points for the PTC Element; Air Clearance and Creep Path

The embodiment of an electrical heating device illustrated in the figures has heat generating elements, which are formed in a special way to lengthen creep paths and to reduce the risk of creepage current transmission. This special arrangement is elucidated in the following, in particular with reference to FIGS. 2 and 11. Thus—as can be seen in FIG. 2—each receptacle 78 specified by a basically flat inner circumferential surface of the positional frame 76 has on oppositely situated sides at least two protrusions labelled with reference numeral 188. The protrusions 188 define supporting points for in each case one PTC element 80 within the receptacle 78. These supporting points 188 prevent the PTC elements 80 from directly abutting the smooth inner wall of the positional frame 76 defining the receptacle 78. Thus, the creep path between opposite surfaces of the PTC elements 80 is enlarged.

As can be seen in particular in FIG. 2, the supporting points 188 are essentially formed pyramid-shaped and therefore have a form tapering to the tip. Furthermore, the surfaces of the supporting points 188 are curved concave, as the sectional view in FIG. 11 shows. The curvature of the surface also enlarges the creep path further. The previously mentioned circumferential gap 84 provided between the contact plates 82 and the positional frame also contributes to extending the creep paths.

Special EMC Protection of the Embodiment

Furthermore, the heat generating elements 66 are particularly EMC protected. For example, the positional frame 76 is basically completely surrounded by a screen, which is formed on one hand by the sheet metal cover 110 of the positional frame 76 and on the other hand by the sheet metal cover 70 of the corrugated-rib elements 64. As illustrated in FIG. 11, only a small gap at the edge between the different covers 70, 110 remains. Other than that, the PTC elements 80 are completely enclosed by a metal screen. Accordingly the heat generating elements 66 cannot emit any substantial electromagnetic radiation.

All the corrugated-rib elements 64 are furthermore joined together by latching elements formed on the metal shell 8, which are not illustrated in the drawing, but can be formed as described in EP 2 299 201 A1 which originates from the applicant, the disclosure of which, to this extent, is included in the disclosure content of this application. It only matters that the metal shell 8 electrically forms joined protrusions which contact the corrugated-rib elements 64 such that all corrugated-rib elements 64 are directly or indirectly electrically joined to the metal shell 8 and are connected to ground.

Sealing and Sealing Test

The previously discussed embodiment has heat generating elements 66, the receptacle 78 of which is hermetically sealed with respect to the ambient, so that moisture and contamination cannot access the PTC elements 80. In this way high insulation of the PTC elements 80 is obtained, since any charge carriers of the insulation of the PTC elements 80, which can access the receptacle 78 in the state of the art, impair the insulation. With the present invention also all heat generating elements 66 are inserted into the connecting housing 6. Normally for checking the required sealing after joining the power section 2 a testing bell is placed on the plastic housing element 10 on its free end, which is usually closed off by the housing cover 12, the said testing bell abutting the free edge of the plastic housing element 10 for sealing. Through this testing bell the part of the electrical heating device connected to it is subjected to increased hydrostatic pressure, for example by compressed air. A certain pressure level is held and checked whether it is reduced over time by any leaks. If this is not the case, the component is assessed as passing the test.

Simplified Assembly

Accordingly, firstly during the manufacture of the illustrated embodiment the power section 2 is manufactured separately. First, the heat generating elements 66 are assembled. Here, the sheet metal cover 110 can close off the underside and thus, in any case after the adherence of the insulating layer 90 assigned to the sheet metal cover 110, the positional frame 76 which is open on one side on the underside, so that the PTC elements 80 can be inserted from the other side and then the assigned contact plate 82 can be placed on them to finally put the insulating layer 90 in place on the said contact plate and to seal it against the positional frame 76 through the adhesive edging 88. In the described method with particular reference to FIG. 11 the thus prepared heat generating elements 66 are put into a frame element 48 of the frame 44 and namely in each case alternating with respect to the arrangement of corrugated-rib elements 64. As arises particularly from FIG. 4, two corrugated-rib elements 64 normally abut in each case between two heat generating elements 66. In other words a layer L of corrugated-rib elements abut on each side of a heat generating element 66. The comparison between FIG. 4 and FIG. 11 also shows that in the embodiment according to FIG. 4 at least two corrugated-rib elements 64 are arranged in a layer.

Once all elements of the layer structure 46 have been placed into the frame element 48, the frame 44 is closed by putting the other frame element 48 into place and latching it. Thereafter, the respective spring elements 121 are inserted through the spring insertion openings 120 between the layer structure 46 and an external edge of the receptacle 60 produced by the frame 44. Finally, the spring elements 121 are clamped against one another as described in EP 2 298 582. Thereafter, the power section 2 prepared in this way is joined to the metal shell 8 and the plastic housing element 10. Due to their form tapering to a tip, the ramp surfaces 124 here act as positioning and centring aids, so that the retaining element 126 can be effectively introduced into the positioning opening 127. The retaining element 126 normally here precedes the contact pins 96 so that first coarse positioning is carried out using the retaining elements 126 and then the contact pins 96 are introduced into the cylindrical sleeve receptacles 132.

Improved Thermal Transfer

FIGS. 12 to 15 illustrate a further aspect of the present invention in that the corrugated-rib elements 64 provided one behind the other in the flow direction in a layer L are provided in a direction transverse to the flow direction S but offset to one another in their corresponding installation level within the layer structure 46. Accordingly, in the enlarged side view of a heating bar 62 illustrated in FIG. 12 the meander-type, bent sheet metal strips 68 of the corrugated-rib elements 64 can be seen provided in a layer L one behind the other. They are labelled with reference numerals 68.1 and 68.2 and can thus be differentiated. It is apparent that the air to be heated flowing at right angles to the drawing plane flows over almost completely separate meander-type, bent sheet metal strips 68.1 and 68.2. In particular the rear sheet metal strip element is not shaded by the front one. Good thermal transfer is produced. Furthermore, the air flow S to be heated is redistributed during the transfer from the first level E1 to the second level E2, which is accompanied by turbulent flow, by means of which the thermal transfer is also improved.

Figure 12:
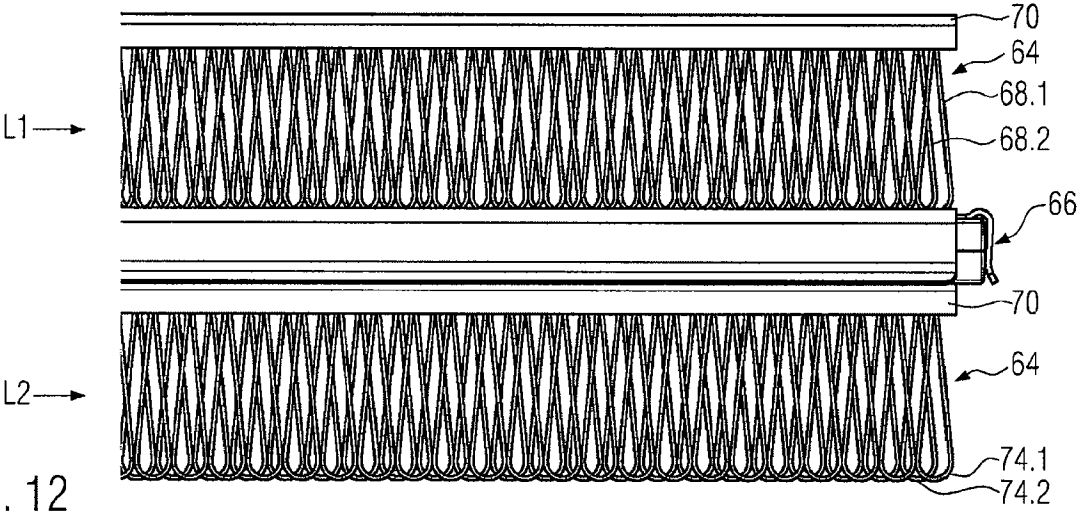
FIG. 12 a side view of the embodiment of a heating bar illustrated in FIG. 10.
Figure 15:
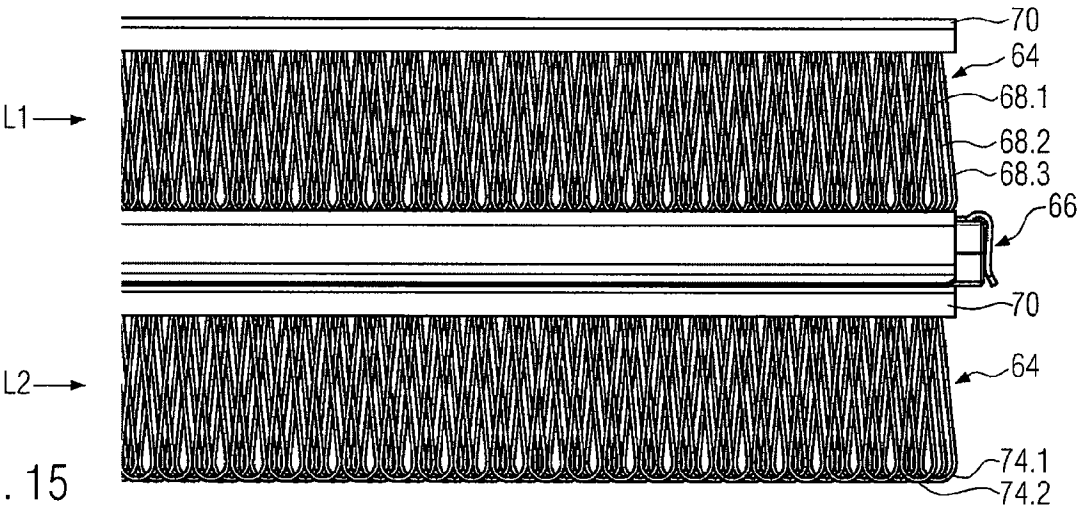
FIG. 15 a side view of the further embodiment of a heating bar illustrated in FIG. 13.
Figure 14:
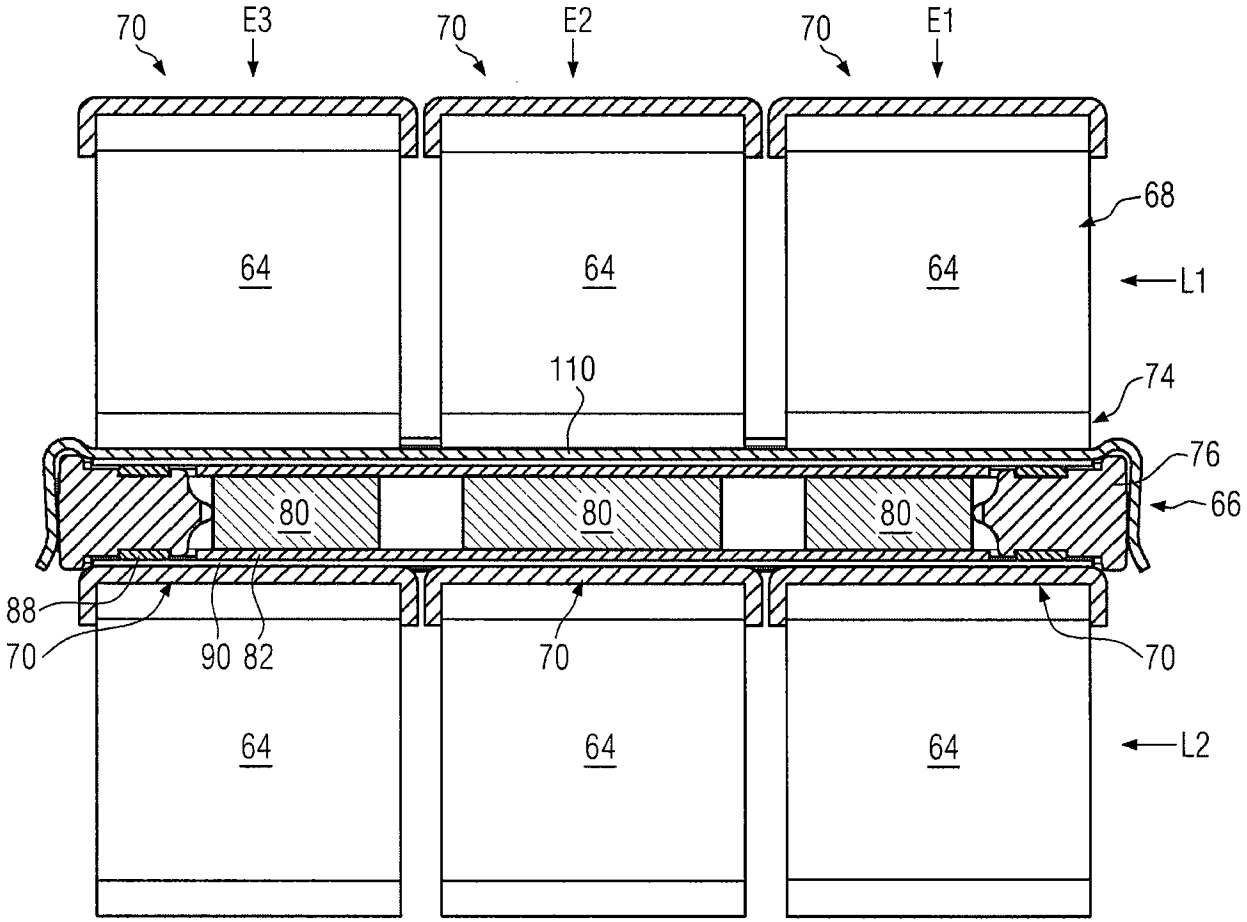
FIG. 14 a cross-sectional view along the line XIV-XIV according to the illustration in FIG. 13.

FIGS. 13 to 15 show a second embodiment according to FIGS. 10 to 12. The illustrated embodiment of a heating bar only differs from the embodiment previously discussed in that three corrugated-rib elements 64 are arranged one behind the other in a layer L1 respectively L2. Here too, corrugated-rib elements 64 each arranged in a level E1, E2, E3 are each strictly assigned to a PTC element 80. As FIG. 15 illustrates, the air flowing through the heating bar 62 is redistributed many times. The labyrinth of sheet metal strips 68.1, 68.2 and 68.3 formed in each case by the meander-type sheet metal strips 68 provided offset to one another leads to very good thermal transfer and power output.

Modular Structure of the Frame

Figure 16:
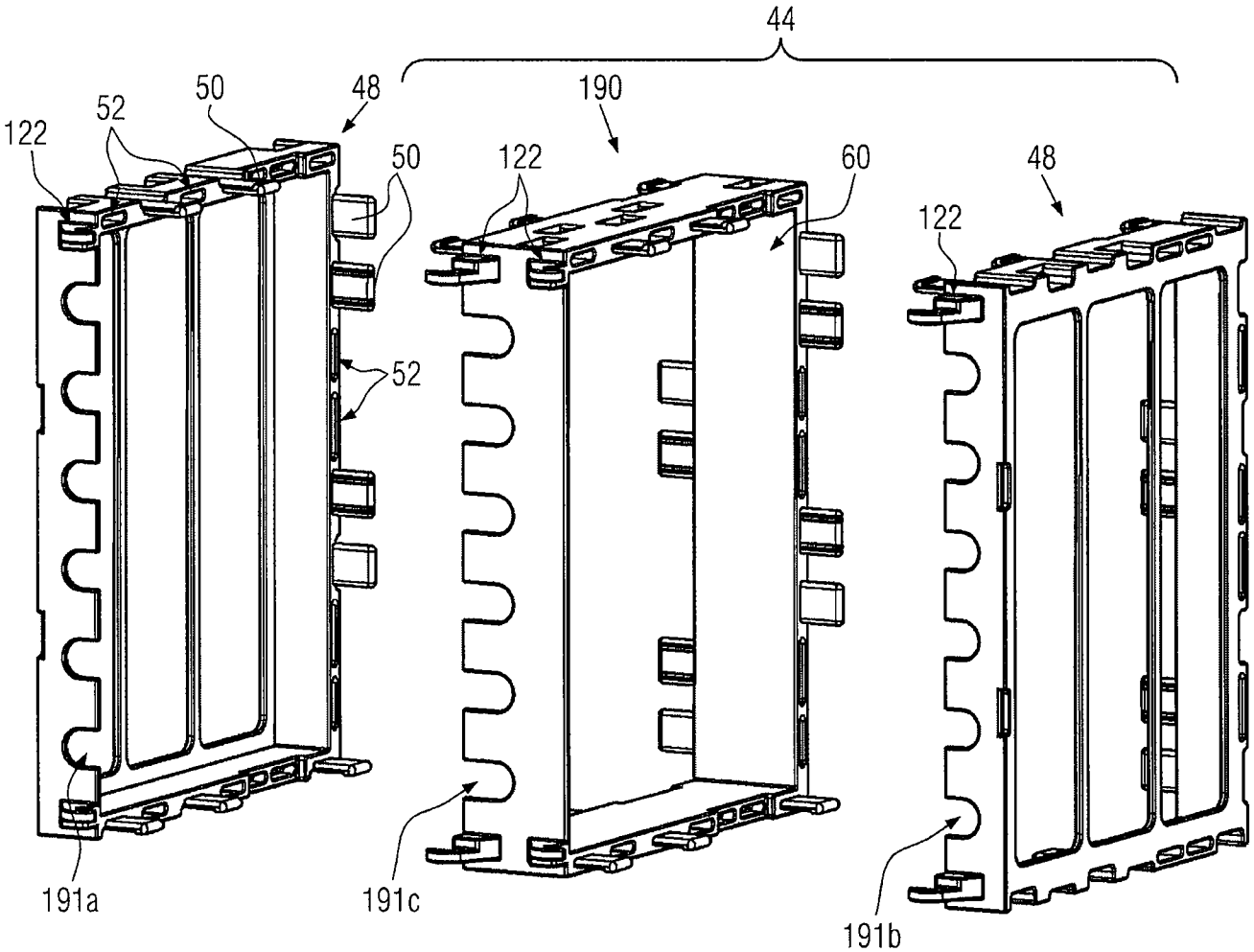
FIG. 16 a perspective exploded view of a frame suitable for accommodating heating bars according to FIGS. 13 to 15.

FIG. 16 shows the already previously described frame elements 48 as well as a frame intermediate element 190 which is provided with female and male latching elements 50, 52 corresponding to the frame elements 48, so that the frame intermediate element 190 can be latched between the frame elements 48 in a simple manner. The receptacle 60 provided in the frame for the layer structure 46 is thus enlarged exactly by the width contributed by the corrugated-rib element 46. With the embodiments of heating bars 62 illustrated in FIGS. 10 to 15 the heat generating elements 66 are each formed uniformly, i.e. irrespective of whether two or three PTC elements 80 are arranged one behind the other in the flow direction S; the PTC elements 80 are each accommodated within a uniform positional frame 76. The corrugated-rib elements 64 are however identical. For the heating bars 62 provided with three corrugated-rib elements 64 arranged adjacent to one another and the heating bars 62 provided with two corrugated-rib elements 64, one identical plastic housing element 10 can be used in each case. This is because the frame intermediate element 190 has retaining element parts 122 which interact with the retaining element parts 122 of one of the frame elements 48 in order to form a complete retaining element 126 through which also the widened frame 44 according to FIG. 16 can be joined to the plastic housing element 10. If, for example, four corrugated-rib elements 64 arranged one behind the other in the flow direction form a heating bar, then a second frame intermediate element 190 can be built into the frame 44.

Figure 17:
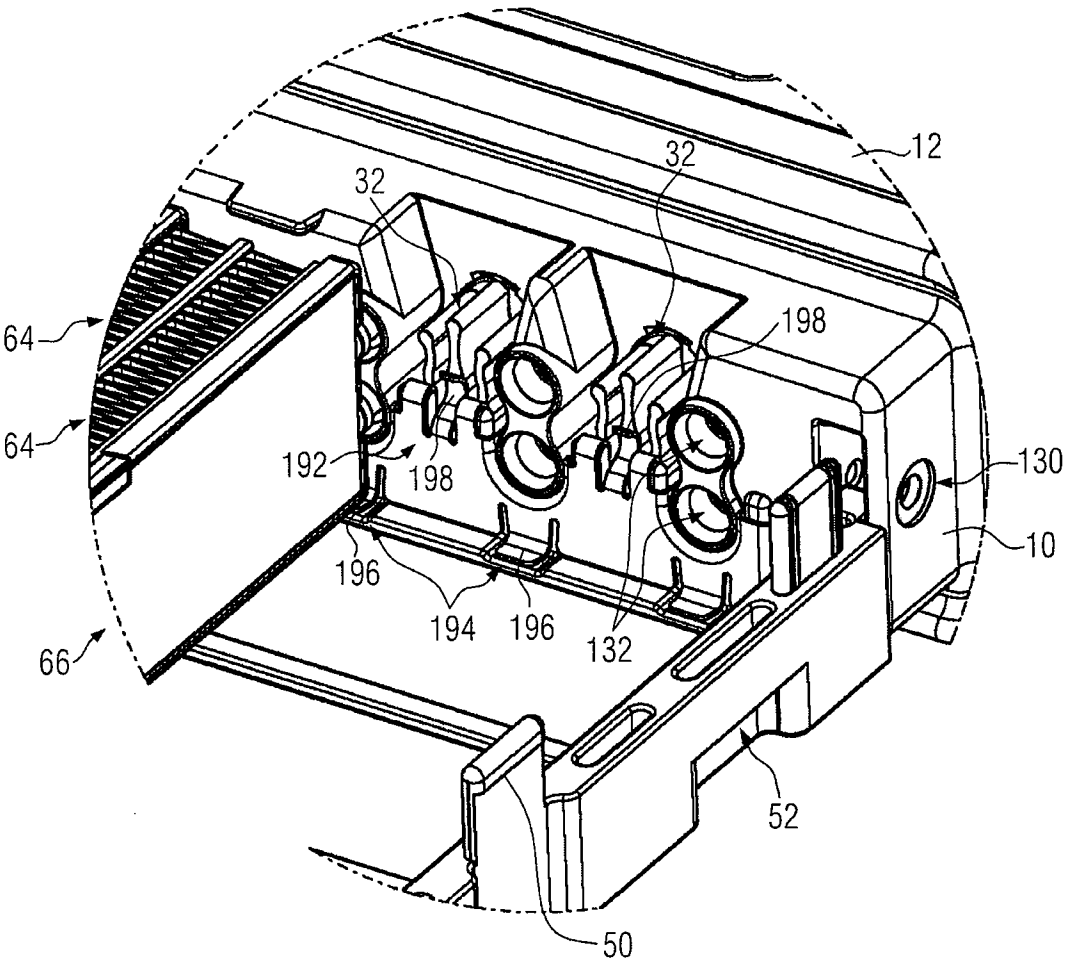
FIG. 17 a perspective plan view onto the edge area of a further embodiment of a heating device according to the invention, partially omitting layers of the layered structure, and FIG. 18 a partially cut-away perspective side view of the embodiment illustrated in FIG. 17.
Figure 18:
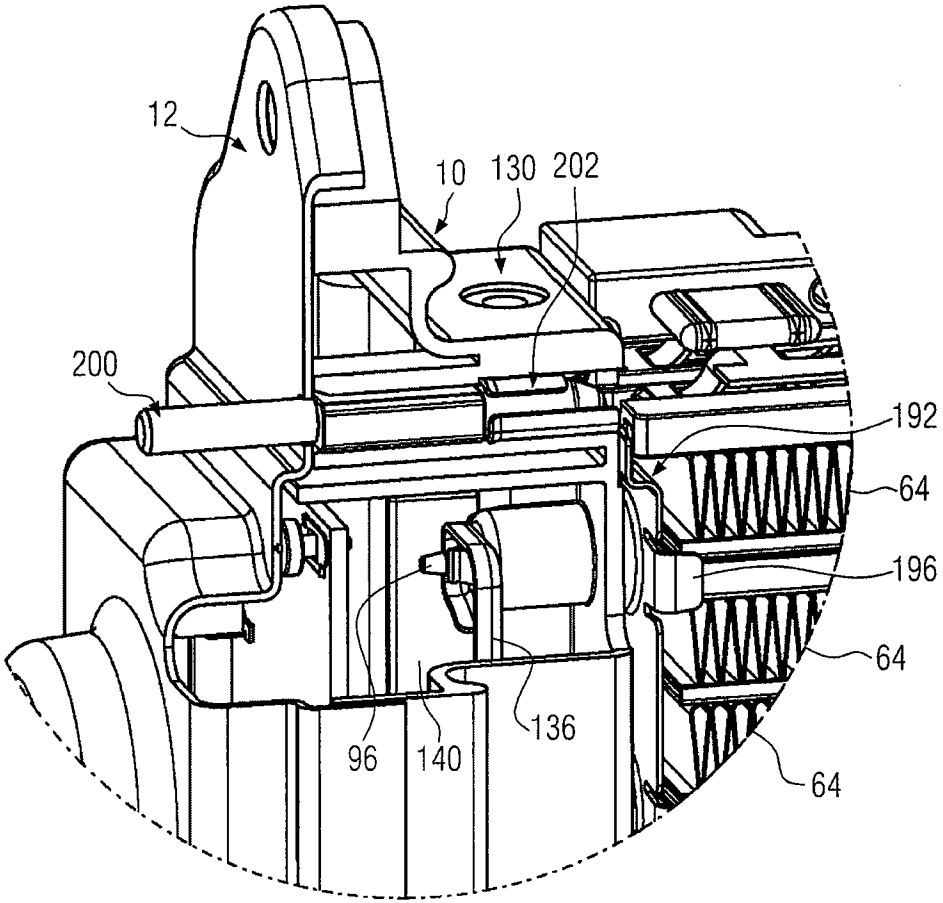

Compared to the previously described embodiment, FIGS. 17 and 18 illustrate a slightly different embodiment. The same parts are labelled with the same reference numerals. The previously described screening housing element 8 particularly differs in the embodiment shown in FIGS. 17 and 18.

Instead of a shell-shaped housing element accommodating the plastic housing element 10, a screening contact plate 192 is provided which abuts, positively locked, outer contact bases of the plastic housing element 10. This furthermore forms cavities 194 in which screening contact tongues 196 of the screening contact plate 192 are accommodated. The screening contact tongues 196 are each provided at the height of a heat generating element 66 and contact the edge 112 of this element 66. Furthermore, the screening contact plate 192 forms spring bars 198, formed by punching and bending, which each abut one of the heat sinks 32 on the face side and contact it. As can be especially seen in FIG. 18, the screening contact plate 192 closely surrounds the cylindrical sleeve receptacle 132, which is formed by the plastic housing element 10.

Furthermore, as can particularly be taken from FIG. 18, the embodiment illustrated in FIGS. 17 and 18 has a connecting bolt 200 connected to ground. This connecting bolt 200 is, for example, held in the plastic housing element 10 by overmoulding. The screening contact plate 192 clipped to the plastic housing element 10 forms a bolt receptacle 202 made through punching and bending which abuts the connection bolt 200 for electrical conduction under elastic circumferential stress.

Complete screening of all current-carrying elements of the embodiment is produced. Furthermore, the heat sinks 32 are connected to ground through the screening contact plate 192, so that the reliable electrical insulation between the power switch 178 and the heat sink 32 can be checked by monitoring the ground potential obtained on the connecting bolt 200. Any defect in the electrical insulation can be detected and output to prevent the service personnel from receiving an electrical shock during service work on the electrical heating device due to inadequate electrical insulation.

What is claimed is:

1. An electrical heating device comprising:

a frame, which forms on oppositely situated sides openings for the passage of a medium to be heated, and a layer structure, which is arranged in the frame and which comprises layers of corrugated rib elements and heat generating elements, wherein each heat generating element has a PTC element arranged between parallel contact plates, wherein the individual layers extend from one opening of the housing to the other in the passage direction of the medium, wherein, in the passage direction of the medium to be heated, and arranged one behind the other within one single layer of the layer structure, at least two corrugated-rib elements are provided, their corrugated ribs being arranged offset laterally to the passage direction of the medium to be heated and within the layer.

2. An electrical heating device according to claim 1, wherein the corrugated-rib elements, which are arranged one behind the other in the passage direction and which each define levels located within the layer structure in the passage direction one behind the other, are assigned in each case PTC elements which are provided in a uniform layer and which are in each case arranged within the levels given by the corrugated-rib elements.

3. An electrical heating device according to according to claim 1, wherein the PTC elements are arranged in a uniform heat generating element extending over several levels.

4. An electrical heating device according to according to claim 1, wherein all corrugated-rib elements and/or all heat generating elements are formed identically.

5. An electrical heating device according to according to claim 1, wherein the frame comprises two frame elements forming the openings and at least one frame intermediate element arranged between them, which can be joined together by mutually engaging latching elements and wherein the elements forming the frame are formed such that a portion of the frame, formed solely by the frame elements, forms an accommodation space extending in the passage direction of the medium to be heated, which is appropriately formed for the accommodation of a layer structure with a level of corrugated ribs and heat generating elements, and that a frame formed by the frame elements and the frame intermediate element forms an accommodation space extending in the passage direction of the medium to be heated, which is appropriately formed for the accommodation of a layer structure with several levels of corrugated ribs and heat generating elements.

6. An electrical heating device according to claim 5, wherein the frame elements are formed identically.

7. An electrical heating device according to claim 6, wherein the frame elements and the frame intermediate element have at least one retaining element part protruding over them, which is shaped such that, on a frame formed solely from the frame elements and on a frame formed from the frame elements and the frame intermediate element a retaining element is formed by interacting retaining element parts.

8. An electrical heating device comprising:

a frame, which forms on oppositely situated sides openings for the passage of a medium to be heated, and a layer structure, which is arranged in the frame and which comprises the layers of corrugated rib elements and heat generating elements, wherein each heat generating element has a PTC element arranged between parallel contact plates, wherein the individual layers extend from one opening of the housing to the other in the passage direction of the medium, wherein in the passage direction of the medium to be heated and arranged one behind the other within one single layer of the layer structure at least two corrugated-rib elements are provided, their corrugated ribs being arranged offset laterally to the passage direction of the medium to be heated and within the layer and wherein the PTC elements are arranged in a uniform heat generating element extending over several levels.

9. An electrical heating device according to claim 8, wherein the corrugated-rib elements, which are arranged one behind the other in the passage direction and which each define levels located within the layer structure in the passage direction one behind the other, are assigned in each case PTC elements which are provided in a uniform layer and which are in each case arranged within the levels given by the corrugated-rib elements.

10. An electrical heating device according to according to claim 8, wherein all corrugated-rib elements and/or all heat generating elements are formed identically.

11. An electrical heating device comprising:

a frame, which forms on oppositely situated sides openings for the passage of a medium to be heated, and a layer structure, which is arranged in the frame and which comprises layers of corrugated rib elements and heat generating elements, wherein each heat generating element has a PTC element arranged between parallel contact plates, wherein the individual layers extend from one opening of the housing to the other in the passage direction of the medium, wherein, in the passage direction of the medium to be heated and arranged one behind the other within one single layer of the layer structure at least two corrugated-rib elements are provided, their corrugated ribs being arranged offset laterally to the passage direction of the medium to be heated and within the layer, wherein the frame comprises two frame elements forming the openings and at least one frame intermediate element arranged between them, which can be joined together by mutually engaging latching elements and wherein the elements forming the frame are formed such that a frame formed solely by the frame elements forms an accommodation space extending in the passage direction of the medium to be heated, which is appropriately formed for the accommodation of a layer structure with a level of corrugated ribs and heat generating elements, and that a frame formed by the frame elements and the frame intermediate element forms an accommodation space extending in the passage direction of the medium to be heated, which is appropriately formed for the accommodation of a layer structure with several levels of corrugated ribs and heat generating elements.

12. An electrical heating device according to claim 11, wherein the frame elements are formed identically.

13. An electrical heating device according to claim 11, wherein the frame elements and the frame intermediate element have at least one retaining element part protruding over them, which is shaped such that, on a frame formed solely from the frame elements and on a frame formed from the frame elements and the frame intermediate element a retaining element is formed by interacting retaining element parts.

14. A frame for an electrical heating device, which forms openings for the passage of a medium to be heated on oppositely situated sides, the frame including a layer structure comprising layers of corrugated-rib elements and at least one heat generating element which abuts said corrugated-rib element and comprises at least one PTC element arranged between parallel contact plates, the frame comprising:

two frame elements forming the openings, and at least one frame intermediate element arranged between them, which can be joined together by mutually engaging latching elements and that the elements forming the frame are formed such that a frame formed solely by the frame elements forms an accommodation space extending in the passage direction of the medium to be heated, which is appropriately formed for the accommodation of the layer structure with a level of corrugated ribs and heat generating elements, and such that that a frame formed by the frame elements and the frame intermediate element forms an accommodation space extending in the passage direction of the medium to be heated, which is appropriately formed for the accommodation of the layer structure with several levels of corrugated ribs and heat generating elements.

15. A frame according to claim 14, wherein the frame elements are formed identically.

16. A frame according to claim 15, wherein the frame elements and the frame intermediate element have on their outer side at least one retaining element part protruding over them, which is shaped such that on a frame formed solely from the frame elements and on a frame formed from the frame elements and the frame intermediate element a retaining element is formed by interacting retaining element parts.

17. A frame according to claim 16, wherein each retaining element part forms a ramp surface such that the retaining element has a configuration which tapers to its free end.

* * * * *